US011445816B2

(12) United States Patent
Averianov

(10) Patent No.: US 11,445,816 B2
(45) Date of Patent: Sep. 20, 2022

(54) TABLE WITH ONE OR MORE TAP GESTURE-ACTIVATED LIGHT INDICATORS

(71) Applicant: Norm, Inc., Wilmington, DE (US)

(72) Inventor: Dmytro Averianov, Odessa (UA)

(73) Assignee: Norm, Inc., Wilmington, DE (US)

( * ) Notice: Subject to any disclaimer, the term of this patent is extended or adjusted under 35 U.S.C. 154(b) by 162 days.

(21) Appl. No.: 16/947,192

(22) Filed: Jul. 22, 2020

(65) Prior Publication Data

US 2021/0022490 A1 Jan. 28, 2021

Related U.S. Application Data

(60) Provisional application No. 62/878,155, filed on Jul. 24, 2019.

(51) Int. Cl.

| | |
|---|---|
| ***A47B 13/08*** | (2006.01) |
| ***A47B 19/10*** | (2006.01) |
| ***A47B 21/007*** | (2006.01) |
| ***A47B 17/06*** | (2006.01) |

(52) U.S. Cl.

CPC ..... *A47B 13/08* (2013.01); *A47B 17/06* (2013.01); *A47B 19/10* (2013.01); *A47B 21/007* (2013.01); *A47B 2200/008* (2013.01)

(58) Field of Classification Search

None

See application file for complete search history.

(56) References Cited

U.S. PATENT DOCUMENTS

| | | | |
|---|---|---|---|
| D92,933 | S | 7/1934 | Sinclair |
| D164,075 | S | 7/1951 | Wallace |
| D190,656 | S | 6/1961 | Glass |
| 3,228,359 | A | 1/1966 | Rich, Jr. |
| 4,011,821 | A | 3/1977 | Neal |
| 4,039,133 | A | 8/1977 | Streicher |
| 4,085,916 | A | 4/1978 | Pedersen |
| D294,318 | S | 2/1988 | Zapf |
| D394,766 | S | 6/1998 | Brandt |

(Continued)

OTHER PUBLICATIONS

International Preliminary Report on Patentability dated Jun. 30, 2021, from the IPEA/US, for International Patent Application No. PCT/US2020/043026 (filed Jul. 22, 2020), 14 pgs.

(Continued)

*Primary Examiner* — Nicholas J Lee

(74) *Attorney, Agent, or Firm* — Ascenda Law Group, PC

(57) ABSTRACT

A table may include one or more tap gesture-activated light indicators that appear on a top surface of the table. The one or more light indicators may indicate a location of one or more wireless charging areas on the top surface of the table. The one or more light indicators may also indicate a location of one or more control elements (e.g., for controlling a height of the table). In a height-adjustable version of the table, each of the height-adjustable legs may include a linear actuator and a telescopic enclosure with a plurality of bulbous members. Additionally, a pressure sensitive surface of the table may measure a pressure pattern generated by a body part of the user resting on the pressure sensitive surface, and a machine learning algorithm infer a posture of the user based on the pressure pattern, and suggest a corrective measure in response to poor posture.

20 Claims, 23 Drawing Sheets

(56) References Cited

U.S. PATENT DOCUMENTS

| | | | | |
|---|---|---|---|---|
| D395,771 | S | 7/1998 | Kelly et al. | |
| D399,684 | S | 10/1998 | Glass | |
| D432,334 | S | 10/2000 | Risdall | |
| D501,103 | S | 1/2005 | Ashby et al. | |
| D508,625 | S | 8/2005 | Frenkler et al. | |
| 7,975,627 | B2 | 7/2011 | Leng | |
| D650,612 | S | 12/2011 | Frinier | |
| 8,136,461 | B2 | 3/2012 | Leng | |
| 8,550,015 | B2 | 10/2013 | Wright | |
| D723,840 | S | 3/2015 | Scharer et al. | |
| D749,880 | S | 2/2016 | Polidoros | |
| D828,061 | S | 9/2018 | Davis et al. | |
| D855,362 | S | 8/2019 | Tham et al. | |
| D865,417 | S | 11/2019 | Chavarria | |
| D878,837 | S | 3/2020 | Reyes | |
| D917,940 | S | 5/2021 | Averianov | |
| 2013/0093708 | A1 | 4/2013 | Annett et al. | |
| 2015/0019963 | A1 | 1/2015 | Park et al. | |
| 2017/0354244 | A1* | 12/2017 | Lee | A61B 5/1036 |
| 2018/0164892 | A1 | 6/2018 | Han et al. | |

OTHER PUBLICATIONS

Invitation to Pay Additional Fees dated Sep. 4, 2020, from the ISA/US, for International Application No. PCT/US2020/043026 (filed Jul. 22, 2020), 2 pgs.

Notice of Allowance dated Nov. 1, 2021, for U.S. Appl. No. 29/788,134, filed Mar. 24, 2021, 15 pgs.

International Search Report and Written Opinion dated Dec. 3, 2020, from the ISA/US, for International Patent Application No. PCT/US2020/043026 (filed Jul. 22, 2020), 13 pgs.

"Ikea Linnmon Desk with Adils Legs Multi Purpose Table." Found online Nov. 19, 2020 at www.amazon.com. Product first available Sep. 4, 2013. Retrieved from URL: https://www.amazon.com/Linnmon-Adils-Multi-Purpose-Black-brown/dp/BOOEYU3E7I (Year: 2013), 2 pgs.

"Regency 48x30 Height Adjustable Classroom Table." Found online Nov. 19, 2020 at www.amazon.com. Product first available Jul. 19, 2016. Retrieved from URL: https://www.amazon.com/Regency-MT4830CHAPBK-Height-Adjustable-Classroom/dp/B01 I P1 JORK?th=1 (Year: 2016), 2 pgs.

"ReunionG Rectangular Kids Activity Table." Found on line Nov. 19, 2020 at www.amazon.com. Product first available Mar. 14, 2019. Retrieved from URL: https://tinyurl.com/y2shca5e (Year: 2019), 2 pgs.

"Olio Designs Spright Series 24x48 Home Office Desk." Found online Nov. 19, 2020 at www.amazon.com. Product first available Aug. 26, 2020. Retrieved from URL: https://www.amazon.com/dp/B08GQ8SVFQ/ref=sbl_dpx_BOOEYU3E7I_O (Year: 2020), 2 pgs.

"Facebook—Norm." Found on line Nov. 20, 2020 at www.facebook.com. Image dated Aug. 11, 2019. Retreived from U RL: https://www.facebook.com/thosearenorm/photos/a.715182522255122/718117078628333/?type=3&theater (Year: 2019), 1 pg.

Non-Final Office Action dated Dec. 7, 2020, for U.S. Appl. No. 29/699,346, filed Jul. 24, 2019, 11 pgs.

Amendment filed Feb. 19, 2021, for U.S. Appl. No. 29/699,346, filed Jul. 24, 2019, 28 pgs.

Interview Summary dated Feb. 22, 2021, for U.S. Appl. No. 29/699,346, filed Jul. 24, 2019, 29 pgs.

* cited by examiner

TABLE WITH ONE OR MORE TAP GESTURE-ACTIVATED LIGHT INDICATORS

RELATED APPLICATIONS

This application is a non-provisional patent application of and claims priority to U.S. Provisional Application No. 62/878,155, filed 24 Jul. 2019, incorporated by reference herein.

FIELD OF THE INVENTION

The present invention relates to a table with one or more tap gesture-activated light indicators, and more specifically relates to a table with one or more tap gesture-activated light indicators indicating a location of one or more wireless charging areas on the table and a tap gesture-activated light indicator indicating a location of one or more control elements for adjusting a height of the table.

BACKGROUND

Tables are an integral furnishing of any work or home office. Prior to the digital revolution, tables in a work or home office were primarily used as a writing or reading surface. Ever since the digital revolution, tables have increasingly been used as a workspace on which various electronic devices (e.g., a computer monitor, laptop, desktop, smartphone, keyboard, etc.) are placed or are used. The basic function of a table as a supporting surface, however, has not evolved much at all despite the digital age.

Discussed herein are various improvements to tables to better accommodate the use of electronic devices in the work or home office.

SUMMARY OF THE INVENTION

In accordance with one embodiment of the invention, a table may include one or more tap gesture-activated light indicators that appear on a top surface of the table. One or more sensors (e.g., a vibration sensor, a pressure sensor) may be disposed within or proximate to the tabletop for detecting the tap gesture performed by a user on the top surface of the tabletop.

The one or more light indicators may indicate a location of one or more wireless charging areas on the top surface of the table, which may be disposed above one or more wireless chargers that are located immediately below the top surface of the table. The one or more wireless chargers may be used to charge a battery of a mobile device (e.g., mobile phone, etc.). The one or more light indicators may also indicate a location of one or more control elements disposed on a bottom surface of the table. That is, the X-Y location of a light indicator on the top surface of the table can guide a user to a corresponding X-Y location on the bottom surface of the table where the control element is located. The one or more control elements may be configured to raise the height of the table, lower the height of the table and/or enable or disable the tap gesture sensors (e.g., to save power when the table is not being used overnight).

The table may additionally include one or more universal serial bus (USB) outlets, in particular a USB-C outlet, disposed on a surface of the tabletop. The table may additionally include one or more power outlets disposed on a surface of the tabletop (e.g., for powering a laptop, monitor, etc.). One or more of the power outlets may be disposed adjacent to or above one or more of the legs of the table, allowing liquid that is spilled into the one or more power outlets to drain from the one or more power outlets through one or more of the legs of the table. The table may additionally include a gyroscope configured to determine whether or not the tabletop is level. The table may additionally include a coupling mechanism (e.g., magnetic coupling) disposed on a bottom surface of the tabletop that is configured to releasably couple with a hook (e.g., for hanging a handbag, backpack, etc.).

The tabletop may include an acrylic stone exterior and an internal cavity within the acrylic stone exterior. A bottom surface of the tabletop may include a removable panel that, when removed, exposes a grid frame disposed within the internal cavity. Various components (e.g., wireless chargers, pressure sensors, gyroscope, etc.) may be secured to the grid frame.

In one embodiment of the invention, the table is height-adjustable and includes a plurality of height-adjustable legs. Each of the height-adjustable legs may include a linear actuator and a telescopic enclosure. The linear actuator may include a nut with an invariant vertical elevation, a screw shaft that is screwed through a central opening of the nut, a motor configured to rotate the screw shaft about a rotational axis of the screw shaft, an inner tubular enclosure that is fixedly secured to the nut, and an outer tubular enclosure that is fixedly secured to the motor. Rotation of the screw shaft may cause the outer tubular enclosure to vertically translate (e.g., upwards or downwards) with respect to the inner tubular enclosure. The telescopic enclosure may enclose the outer tubular enclosure. In one embodiment, the telescopic enclosure may include a plurality of bulbous members.

In one embodiment of the invention, a pressure sensitive surface of the table may measure a pressure pattern generated by one or more of a hand, forearm or elbow of the user resting on the pressure sensitive surface, and a machine learning algorithm may be used to infer a posture of the user based on the pressure pattern. In response to determining that the posture of the user deviates from an ergonomic posture, an alert may be transmitted to the user, informing the user of the deviation from the ergonomic posture. The alert may be in the form of a tactile alert (e.g., vibration of the table) and/or a message displayed on a display device of the user (e.g., the message informing the user of the deviation from the ergonomic posture). In response to the posture of the user deviating from an ergonomic position, the display device may additionally display a message that suggests the user to take a corrective measure (e.g., raising a height of the table, lowering the height of the table, working in a standing position and/or sitting in an upright position).

These and other embodiments of the invention are more fully described in association with the drawings below.

DETAILED DESCRIPTION OF THE INVENTION

Figure 1A:
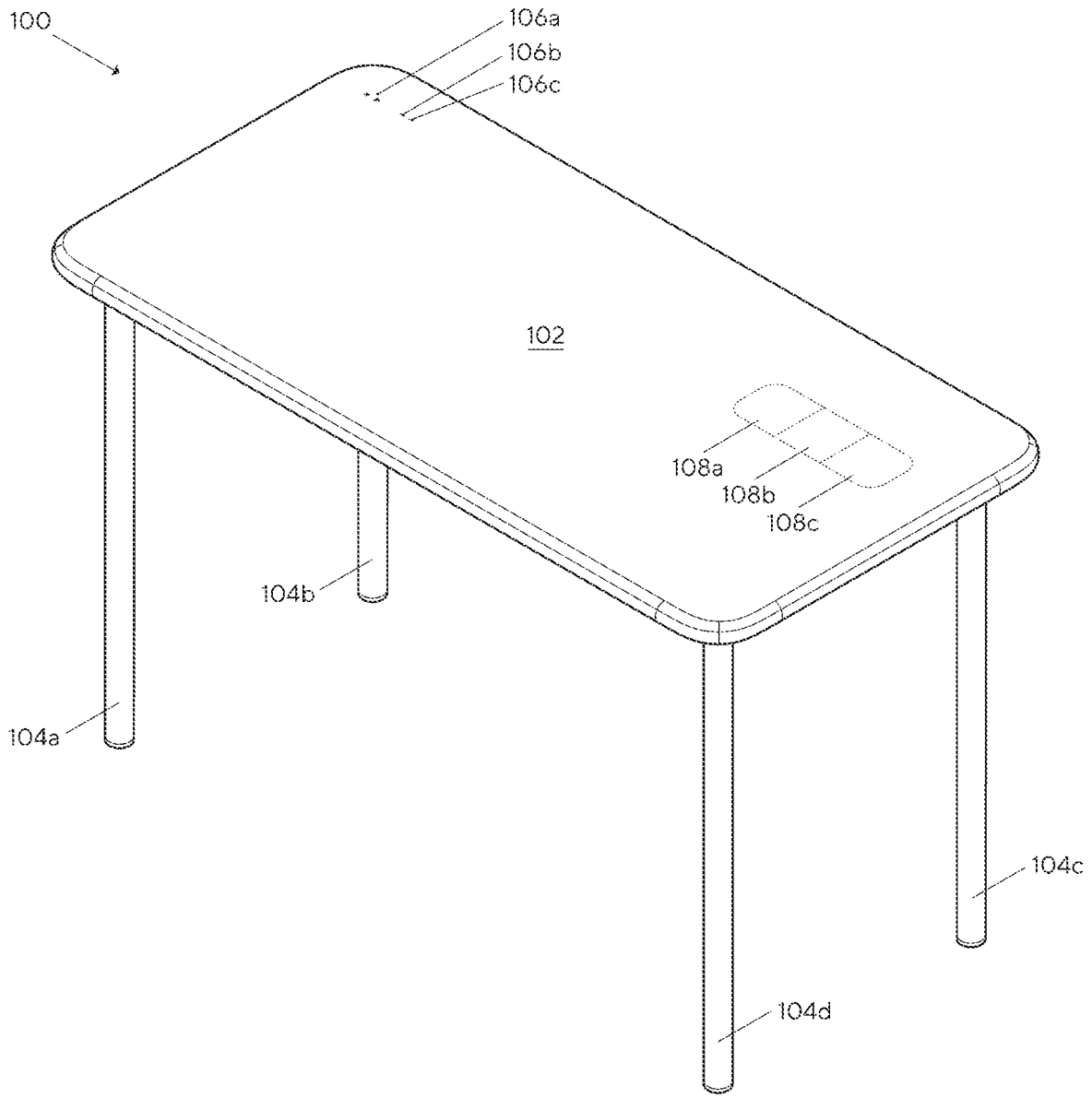
FIG. 1A depicts a top perspective view of a fixed-height table in a non-illuminated state, in accordance with one embodiment of the invention.

FIG. 1A depicts a top perspective view of fixed-height table 100 in a non-illuminated state. Fixed-height table 100 may include tabletop 102 that is supported by two or more legs. In the embodiment depicted in FIG. 1A, tabletop 102 is supported by four legs 104*a*, 104*b*, 104*c* and 104*d*, each positioned near a corner of tabletop 102. Tabletop 102 may include an acrylic stone exterior with an internal cavity (not visible in FIG. 1A). The acrylic stone material has numerous advantageous properties, including being water resistant, scratch resistant, heat resistant (i.e., resistant to damage when a hot cup of coffee is placed onto the surface of tabletop 102), etc.

Tabletop 102 may include one or more power outlets. In the embodiment of FIG. 1A, the top surface of tabletop 102 includes universal power outlet 106*a* (capable of receiving electrical plugs adhering to European standards as well as US standards), and universal serial bus (USB) outlets 106*b* and 106*c*. More specifically, USB outlets 106*b* and 106*c* may be USB-C outlets. It is noted that universal power outlet 106*a* may be disposed adjacent to or above leg 104*b*, allowing liquid (e.g., coffee) that is spilled into universal power outlet 106*a* to drain from universal power outlet 106*a* through leg 104*b*.

Tabletop 102 may include one or more wireless charging areas located on a top surface of tabletop 102. When a mobile device (e.g., a smart phone, a tablet, etc.) is placed within or near the wireless charging area, a wireless charger disposed immediately beneath the wireless charging area is configured to wirelessly charge a battery of the mobile device. In the embodiment of FIG. 1A, three wireless charging area 108*a*, 108*b* and 108*c* are present on tabletop 102. The respective outlines of the wireless charging areas are depicted in broken line in FIG. 1A to reflect an embodiment of the invention in which the respective boundaries of the wireless charging areas are not marked on the top surface of tabletop 102 (e.g., for aesthetic reasons). It is understood that the number of wireless charging areas may differ in another embodiment of the invention.

Figure 1B:
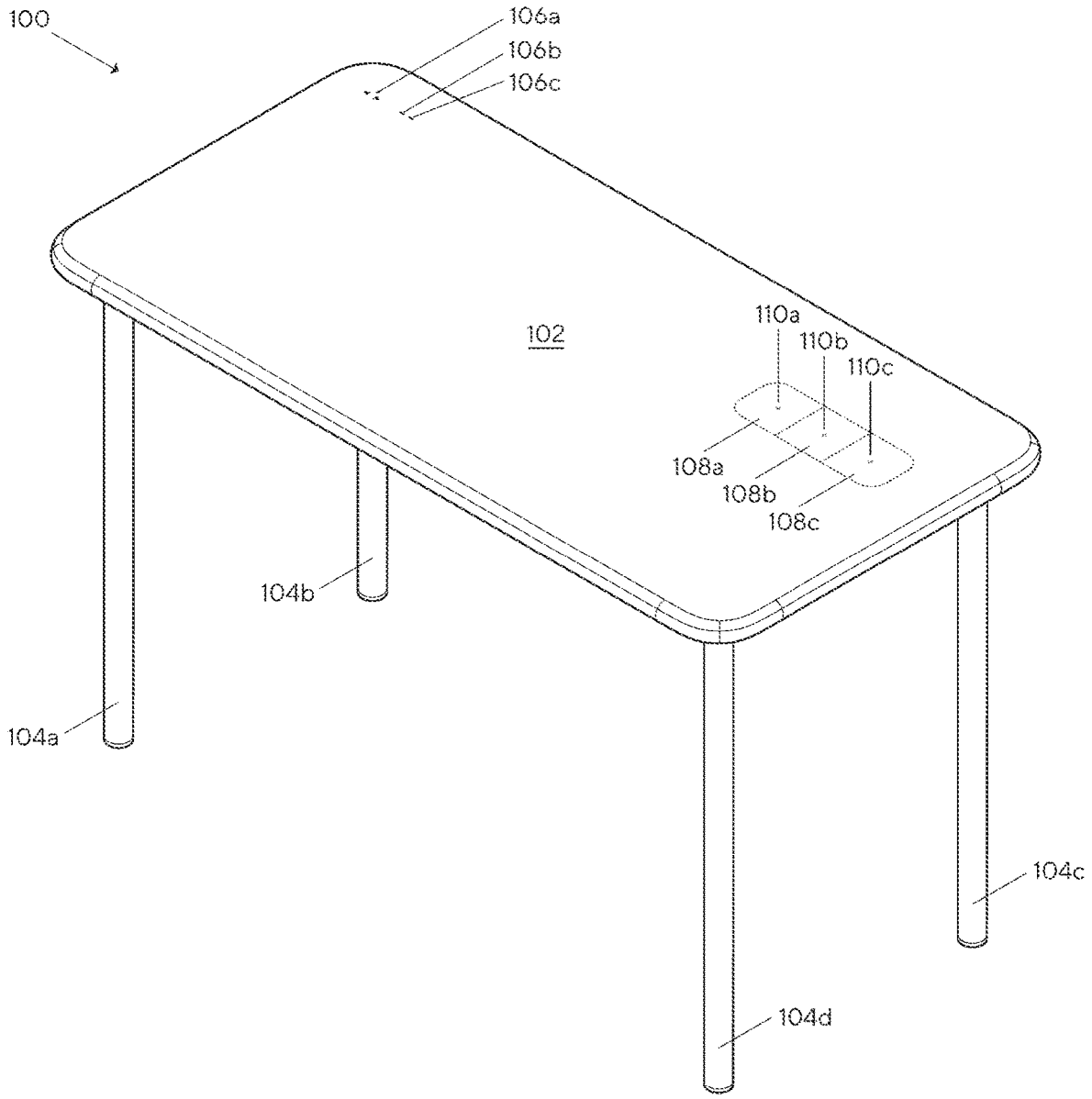
FIG. 1B depicts a top perspective view of a fixed-height table in an illuminated state, in accordance with one embodiment of the invention.

FIG. 1B depicts a top perspective view of fixed-height table 100 in an illuminated state. Upon a user performing a tap gesture (e.g., single tap, double tap in rapid succession, etc.) on a surface of tabletop 102 (e.g., the surface described later in more detail as a pressure or touch sensitive surface), one or more light indicators may appear on the top surface of tabletop 102. It is understood that a tap gesture is merely an example of a human-based gesture that could be used to turn on the one or more light indicators. Other gestures may include a swipe gesture, a check gesture, a gesture that draws a shape or symbol on the surface of tabletop 102 (e.g., draw circle, draw plus sign, etc.).

One or more light sources (not depicted in FIG. 1B) may be present immediately below the top surface of the tabletop and shine light through a translucent (or transparent) portion of the top surface of tabletop 102 to generate the light indicators. In the embodiment depicted in FIG. 1B, three light indicators 110*a*, 110*b* and 110*c* are present to indicate the location of wireless charging areas 108*a*, 108*b* and 108*c*, respectively. In one embodiment, each of the light indicators appears as a "+" symbol on the top surface of tabletop 102, but it is understood that other symbols, and shapes may be used instead of the "+" symbol. While the light indicators indicated the location of the wireless charging areas in the embodiment of FIG. 1B, light indicators may indicate other features of table 100, as will be described in the subsequent figures.

Figure 1C:
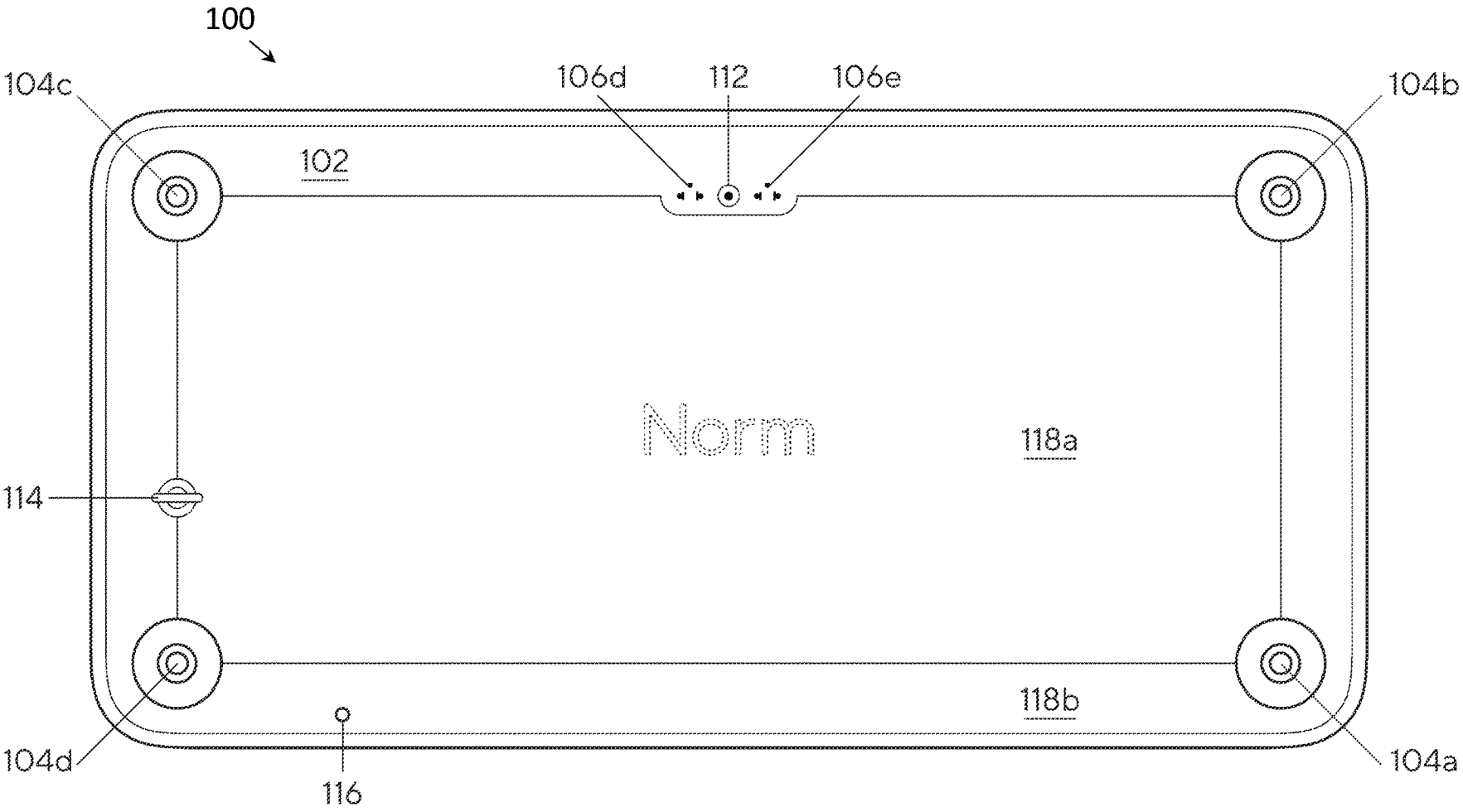
FIG. 1C depicts a bottom view of the fixed-height table, in accordance with one embodiment of the invention.

FIG. 1C depicts a bottom view of fixed-height table 100. A bottom surface of tabletop 102 may include removable panel 118*a* and fixed panel 118*b*. Removable panel 118*a* may be secured to tabletop 102 using screws (not depicted). When removable panel 118*a* is removed from table 100, an internal cavity of table 100 may be accessed. The contents of the internal cavity will be described in FIGS. 2A and 2B below.

A bottom surface of tabletop 102 may also include additional power outlets. In the embodiment depicted in FIG. 1C, two universal power outlets 106*d* and 106*e* are present. Power outlets 106*d* and 106*e* may be convenient for plugging in the power cable of a monitor and the power cable of a laptop or desktop computer. In between power outlets 106*d* and 106*e* may be an internal electrical port 112, used to supply power to various internal electrical components of table 100.

A bottom surface of tabletop 102 may also include coupling mechanism 114 (e.g., a magnetic coupling mechanism) to releasably secure a hook to a bottom surface of tabletop 102. The hook (not depicted) may be a convenient accessory for a user to hang a backpack, handbag, scarf and/or hat underneath tabletop 102. An advantage of a magnetic coupling mechanism (as opposed to other coupling mechanisms, such as using screws to attach a hook to the bottom surface of tabletop 102) is the ease of assembly (i.e., no screw driver or hand-held drill is needed).

A bottom surface of tabletop 102 may also include control element 116 for enabling and disabling components involved with the sensing the tap (or other) gesture. For instance, to save power upon finishing the use of table 100 (e.g., when leaving the work office to return home at the end of the day), a user may press control element 116 to disable components involved with the sensing the tap gesture. Upon resuming the use of table 100 (e.g., when returning to the work office the next day), the user may press control element 116 to re-enable components involved with the sensing of the tap gesture.

Figure 1D:
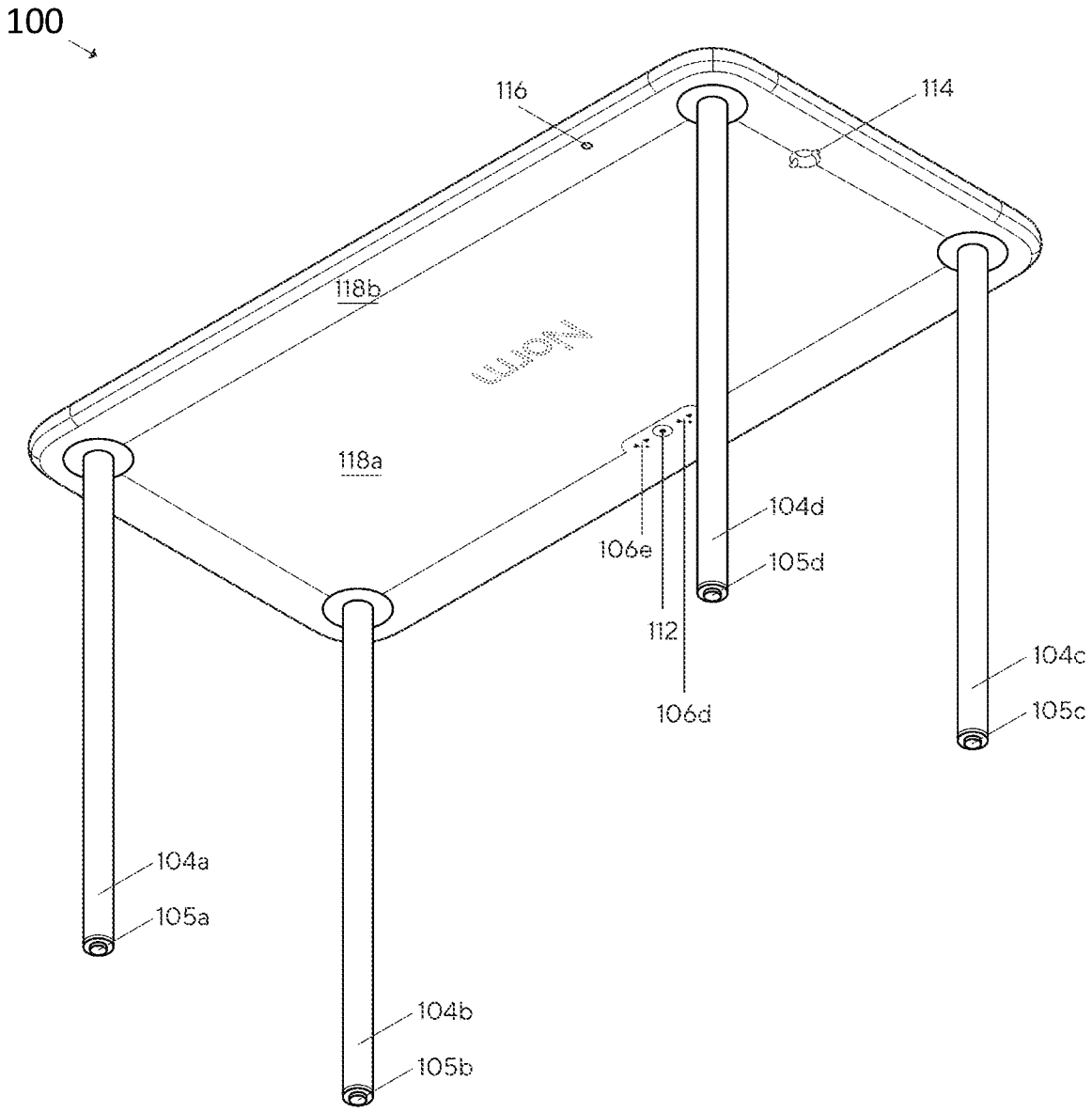
FIG. 1D depicts a bottom perspective view of the fixed-height table, in accordance with one embodiment of the invention.

FIG. 1D depicts a bottom perspective view of fixed-height table 100. The components that are visible in the bottom perspective view of fixed-height table 100 are identical to the components that are visible in the bottom view of fixed-height table 100, so no additional description will be provided in association with FIG. 1D for conciseness.

Figure 1E:
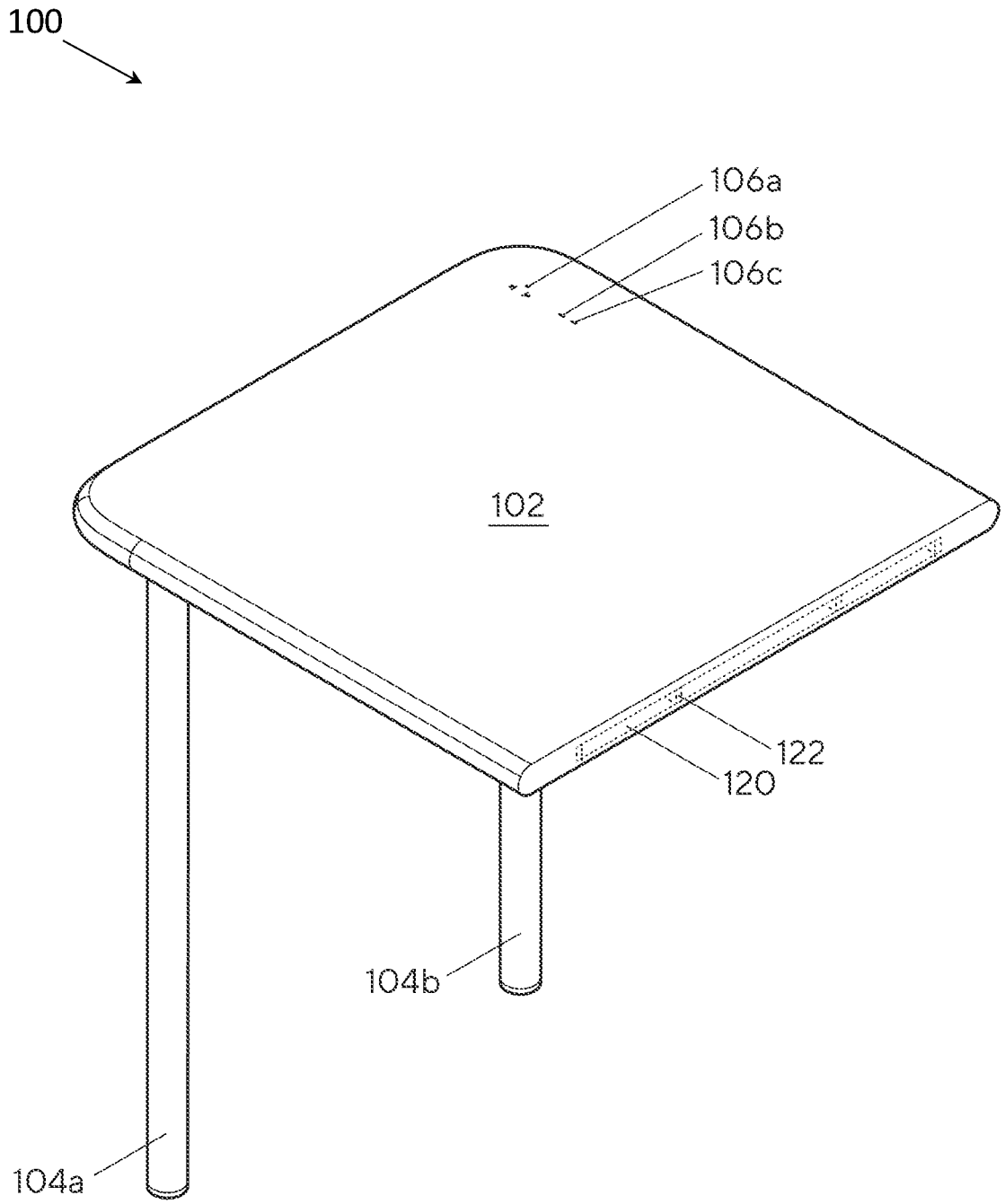
FIG. 1E depicts a sectional perspective view of the fixed-height table with a cutting plane perpendicular to the top surface of the table, in accordance with one embodiment of the invention.

FIG. 1E depicts a sectional perspective view of fixed-height table 100 with a cutting plane perpendicular to the plane of the top surface of the table. Cavity 120 is visible in the cross-sectional surface exposed in the sectional perspective view. Cavity 120 may include frame 122, which may be a grid made from a rigid material, such as aluminum. Frame 122 may provide structural integrity to tabletop 102 (e.g., preventing warping, bending, sagging, etc.). The rounded edge of tabletop 102 is visible in the cross-sectional surface exposed in the sectional perspective view. The rounded edge may allow a user to more comfortably rest his or her elbows on tabletop 102 when using a computer keyboard.

Figure 2A:
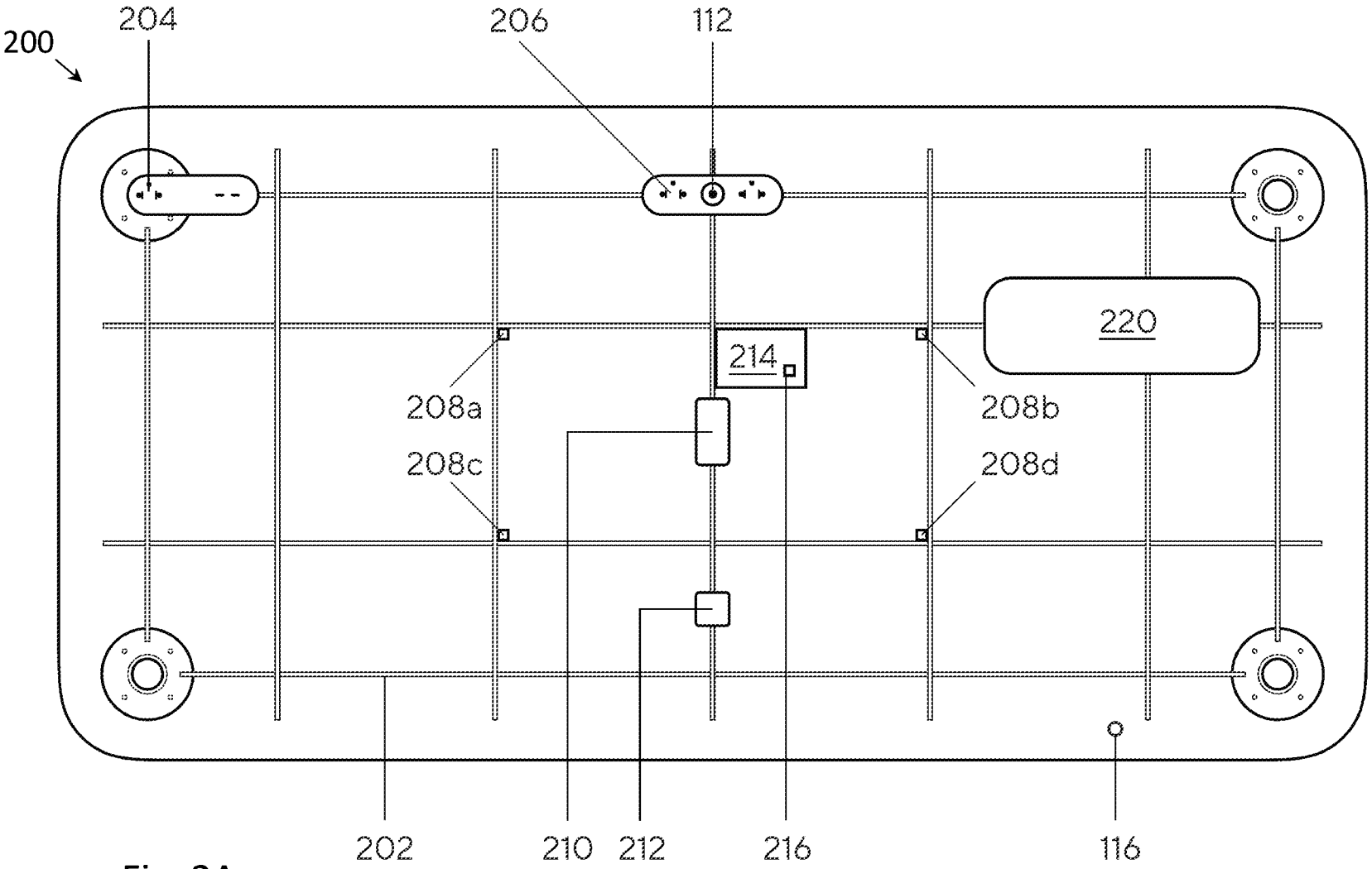
FIG. 2A depicts a top cross-sectional view of the fixed-height table, in accordance with one embodiment of the invention.

FIG. 2A depicts a top cross-sectional view of tabletop 102 (i.e., cross-section of tabletop 102 when viewed from the top), in which various internal components of tabletop 102 are visible. Frame 202 (e.g., in the form of a grid) may be present within the cavity of tabletop 102. Anchored to frame 202 may be power board 204 with power socket 106*a* and USB ports 106*b*, 106*c*. Also anchored to frame 202 may be power board 206 with power sockets 106*d* and 106*e*, and internal electrical port 112 Also anchored to frame 202 may be one or more pressure sensors. In the embodiment depicted in FIG. 2A, four pressure sensors 208*a*, 208*b*, 208*c* and 208*d* may be present, but it is understood that additional pressure sensors (not depicted) may be present. While pressure sensors are depicted as being located in cavity 120 of tabletop 102, it is noted that in another embodiment (not depicted), the pressure sensors could instead be located on a top surface of tabletop 102 (or could be embedded into the acrylic stone exterior). Also anchored to frame 202 may be gyroscope 210, which is configured to sense vibrations and the position of table 100 (e.g., whether the table is level, wobbling, etc.). Also anchored to frame 202 may be taptic engine 212, which is configured to output tactile stimuli (e.g., vibration) that may be felt by a user's hand and/or finger on a surface of tabletop 102. Also anchored to frame 202 may be wireless charger 220, which is configured to wirelessly charge a battery of a mobile device placed on or near wireless charging areas 108*a*, 108*b* and 108*c*. Also anchored to frame may be computing device 214 with vibration sensor 216.

Figure 2B:
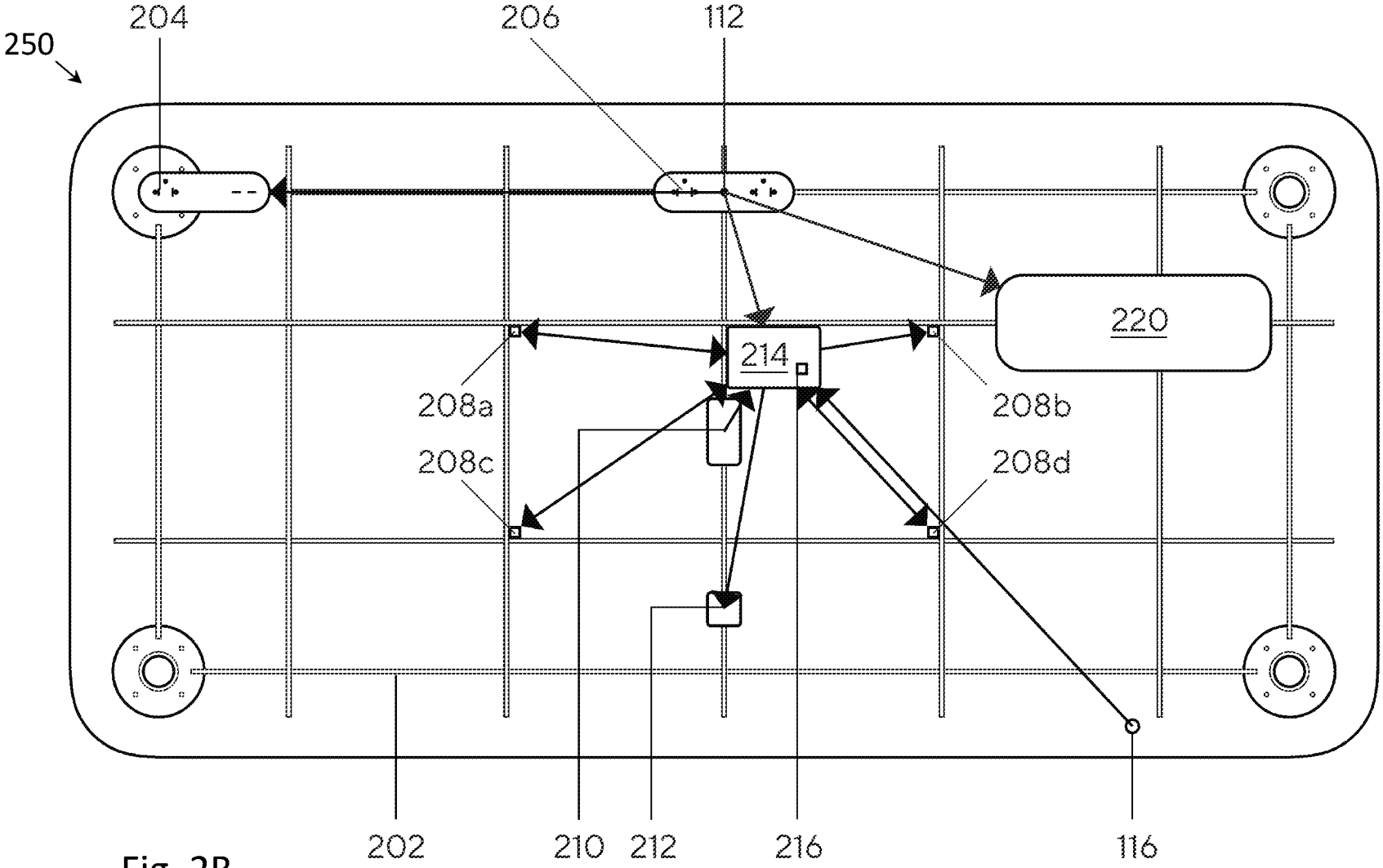
FIG. 2B depicts a schematic drawing in which various internal components of the fixed-height table are electrically connected and/or communicatively coupled to one another, in accordance with one embodiment of the invention.

As depicted in schematic drawing 250 of FIG. 2B, computing device 214 may be communicatively coupled to various electrical components of tabletop 102. Computing device 214 may be configured to receive an on/off signal from control element 116. For example, a waveform (e.g., pulse waveform) from control element 116 may cause computing device 214 to be powered on. Likewise, a waveform (e.g., pulse waveform) from control element 116 may cause computing device 214 to be powered off. Computing device 214 may be configured to receive pressure readings from one or more of pressor sensors 208*a*, 208*b*, 208*c* and 208*d*. Such pressure readings may be processed by computing device 214 to determine the occurrence of a tap gesture (or other gesture) performed by a user on tabletop 102. In response to detecting the tap gesture, computing device 214 may power on wireless charger 220 (and the light sources depicted in FIG. 3). Pressure readings may also be processed by computing device 214 to determine a posture of user (e.g., whether a proper ergonomic position or an improper ergonomic position). Upon the determination of an improper ergonomic position, computer device 214 may transmit a signal to activate taptic engine 212, in turn generating a vibrational alert to notify the user of the improper ergonomic position. In another embodiment, upon the determination of an improper ergonomic position, computer device 214 may wireless transmit a message to a display of a mobile device (e.g., laptop, smartphone, etc.), the message alerting the user of the improper ergonomic position. Optionally, a remediation measure may also be displayed, such as "Please sit up!"

Figure 3:
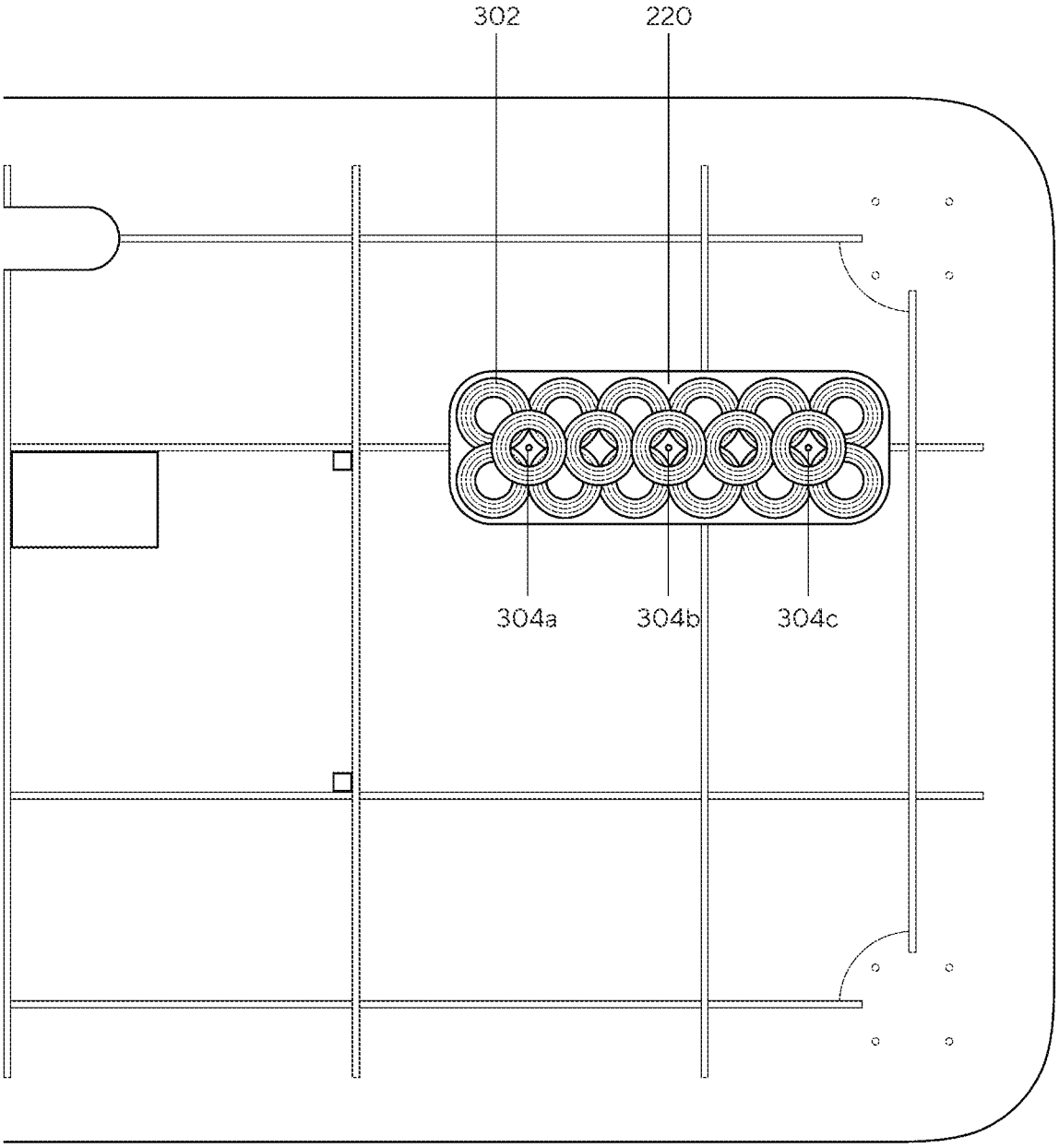
FIG. 3 depicts additional details of the wireless chargers and light sources arranged within or proximate to the wireless chargers, in accordance with one embodiment of the invention.

In addition to or instead of using the pressure sensors, vibration sensor 216 may also be used to detect a tap-gesture, and in response to detection of the tap-gesture, computing device 214 may power on wireless charger 220 (and the light sources depicted in FIG. 3).

In addition to or instead of using the pressure sensors, gyroscope 210 may also be used to detect a tap-gesture, and in response to detection of the tap-gesture, computing device 214 may power on wireless charger 220 (and the light sources depicted in FIG. 3). Gyroscope 210 may also transmit a position-related signal to processor 214, allowing processor 214 to determine and report to a user whether table 100 is level (or not) and wobbling (or not). While the height of legs 104*a*, 104*b* 104*c* and 104*d* is not adjustable via a linear actuator, the height of the legs is still manually adjustable (e.g., by adjusting the distance that pads 105*a*, 105*b*, 105*c*, 105*d* protrude from legs 104*a*, 104*b*, 104*c* and 104*d*, respectively). Hence, remediation measures to address a non-level or wobbling table can be manually performed.

If not already apparent, power board 206 is configured to supply power to computing device 214, taptic engine 212 (electrical connection not depicted), wireless charger 220 and light sources 304*a*, 304*b* and 304*c* (electrical connections not depicted).

FIG. 3 depicts the components of wireless charger 220 in more detail. Wireless charger 220 may comprise a grid of wire coils 302. Within or proximate to the grid of wire coils 302 may be one or more light sources 304*a*, 304*b* and 304*c* (e.g., LEDs) that are used to generate the one or more light indicators 110*a*, 110*b* and 110*c* on the top surface of tabletop 102.

Figure 4A:
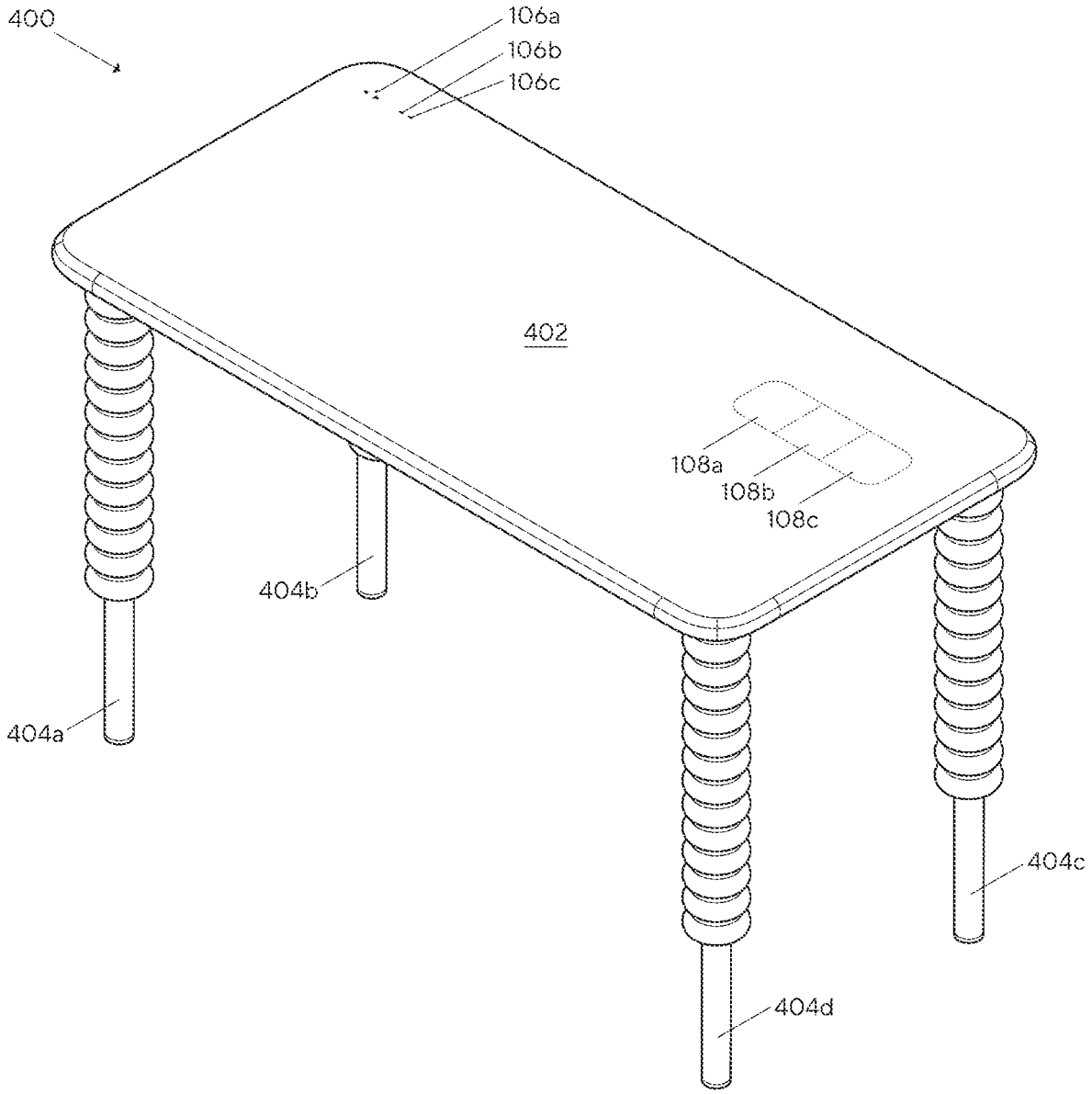
FIG. 4A depicts a top perspective view of an adjustable-height table in the non-illuminated state, in accordance with one embodiment of the invention.

FIG. 4A depicts a top perspective view of adjustable-height table 400 in a non-illuminated state. Adjustable-height table 400 may include tabletop 102 that is supported by two or more height-adjustable legs. In the embodiment depicted in FIG. 4A, tabletop 102 is supported by four height-adjustable legs 404*a*, 404*b*, 404*c* and 404*d*, each positioned near a corner of tabletop 402. Similar to tabletop 102 of the fixed-height table 100, tabletop 402 may include an acrylic stone exterior with an internal cavity (not visible in FIG. 4A).

Tabletop 402 may include one or more power outlets. In the embodiment of FIG. 4A, the top surface of tabletop 402 includes universal power outlet 106*a* (capable of receiving electrical plugs adhering to European standards as well as US standards), and universal serial bus (USB) outlets 106*b* and 106*c*. More specifically, USB outlets 106*b* and 106*c* may be USB-C outlets.

Tabletop 402 may include one or more wireless charging areas located on a top surface of tabletop 102. When a mobile device (e.g., a smart phone, a tablet, etc.) is placed within or near the wireless charging area, a wireless charger disposed immediately beneath the wireless charging area is configured to wirelessly charge a battery of the mobile device. In the embodiment of FIG. 4A, three wireless charging area 108*a*, 108*b* and 108*c* are present on tabletop 402. The respective outlines of the wireless charging areas are depicted in broken line in FIG. 4A to reflect an embodiment of the invention in which the respective boundaries of the wireless charging areas are not marked on the top surface of tabletop 402 (e.g., for aesthetic reasons). It is understood that the number of wireless charging areas may differ in another embodiment of the invention.

Figure 4B:
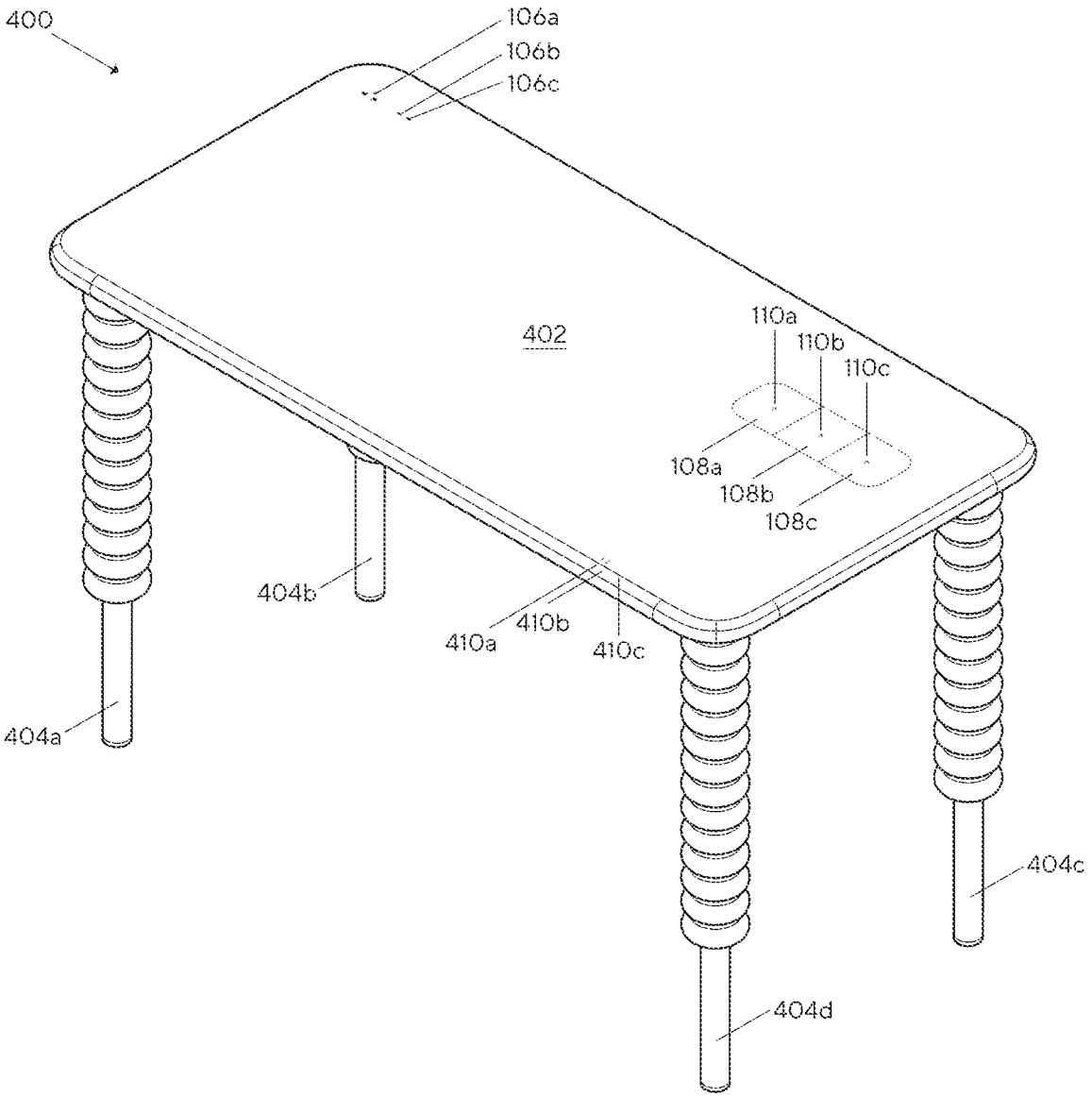
FIG. 4B depicts a top perspective view of the adjustable-height table in the illuminated state, in accordance with one embodiment of the invention.

FIG. 4B depicts a top perspective view of adjustable-height table 400 in an illuminated state. Upon a user performing a tap gesture (e.g., single tap, double tap in rapid succession, etc.) on a surface of tabletop 402, one or more light indicators may appear on the top surface of tabletop 102. One or more light sources (not depicted in FIG. 4B) may be present immediately below the top surface of the tabletop and shine light through a translucent portion of the top surface of tabletop 402 to generate the light indicators. In the embodiment depicted in FIG. 4B, three (gesture-activated) light indicators 110*a*, 110*b* and 110*c* are present to indicate the location of wireless charging areas 108*a*, 108*b* and 108*c*, respectively. In one embodiment, each of the light indicators appears as a "+" symbol on the top surface of tabletop 402, but it is understood that other symbols, and shapes may be used instead of the "+" symbol.

In the embodiment depicted in FIG. 4B, (gesture-activated) light indicators 410*a*, 410*b* and 410*c* are also present. Light indicator 410*a* may direct a user to the location of control element 416*b* on the back surface of tabletop 402 (depicted in the bottom view of FIG. 4C) that can be used to raise the height of adjustable-height table 400. As a visual aid that is associated with the action of raising the height of adjustable-height table 400, light indicator 410*a* may be an "up arrow" symbol, as depicted. It is understood that other symbols are possible, such as "R" as an abbreviation for the action of "raise".

In a similar fashion, light indicator 410*b* may direct a user to the location of control element 416*a* on the back surface of tabletop 402 (depicted in the bottom view of FIG. 4C) that can be used to lower the height of adjustable-height table 400. As a visual aid that is associated with the action of lowering the height of adjustable-height table 400, light indicator 410*b* may be a "down arrow" symbol, as depicted. It is understood that other symbols are possible, such as "L" as an abbreviation for the action of "lower".

Light indicator 410*c* may direct a user to the location of control element 116 on the back surface of tabletop 402 (depicted in the bottom view of FIG. 4C) that can be used to enable and disable components involved with the sensing of the tap (or other) gesture. It is noted that an advantage to having control elements 116, 416*a* and 416*b* located on the back surface of tabletop 402 (as opposed to the top surface) is to decrease the chance of a user accidentally pressing the control elements, which would be more likely if such control elements were present on the top surface of tabletop 402.

Figure 4C:
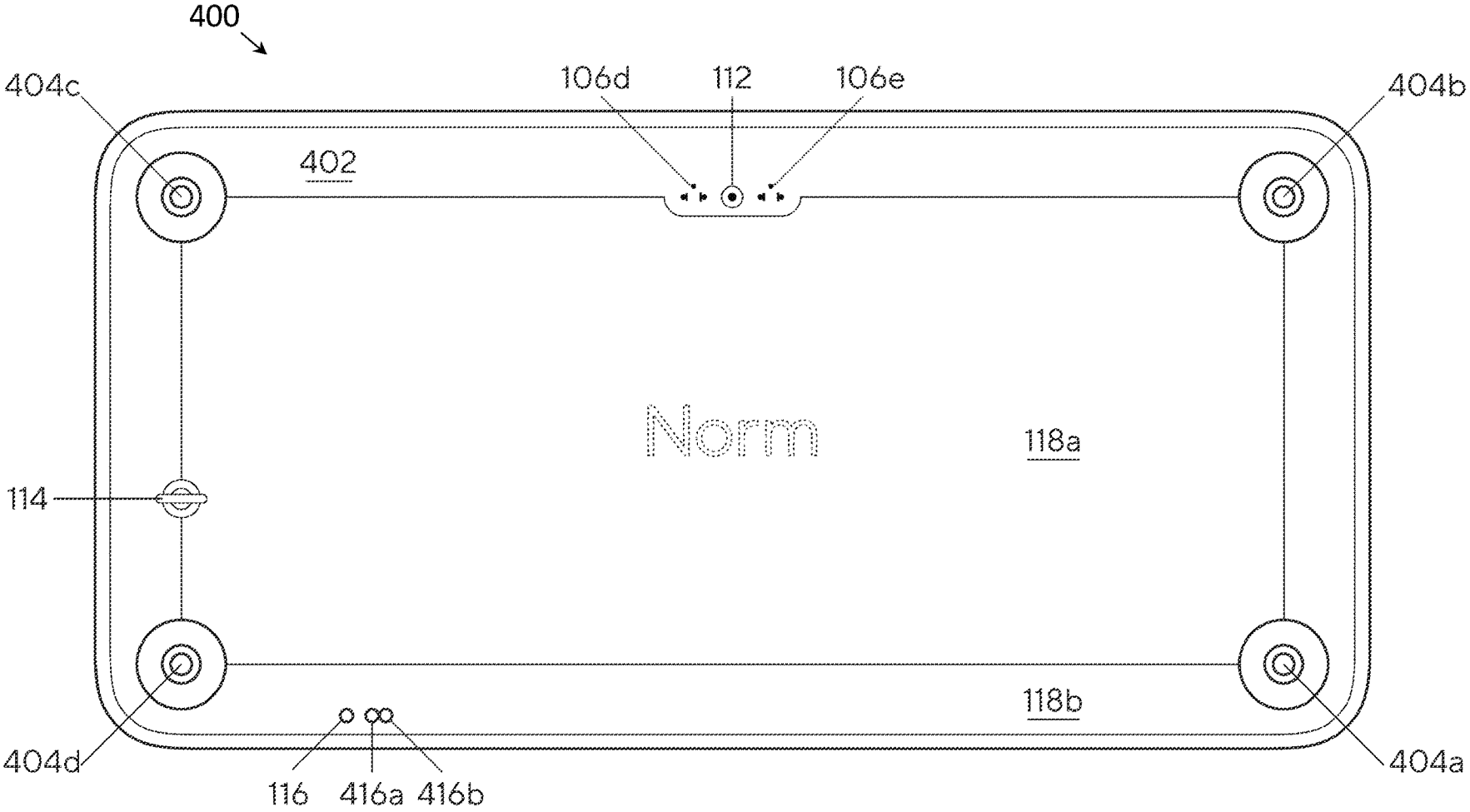
FIG. 4C depicts a bottom view of the adjustable-height table, in accordance with one embodiment of the invention.

FIG. 4C depicts a bottom view of adjustable-height table 400. A bottom surface of tabletop 102 may include removable panel 118*a* and fixed panel 118*b*. Removable panel 118*a* may be secured to tabletop 402 using screws (not depicted). When removable panel 118*a* is removed from table 400, an internal cavity of table 400 may be accessed. A bottom surface of tabletop 402 may also include additional power outlets. In the embodiment depicted in FIG. 4C, two universal power outlets 106*d* and 106*e* are present. Power outlets 106*d* and 106*e* may be convenient for plugging in the power cable of a monitor and the power cable of a laptop or desktop computer.

A bottom surface of tabletop 402 may also include coupling mechanism 114 (e.g., a magnetic coupling mechanism) to releasably secure a hook to a bottom surface of tabletop 402. The hook (not depicted) may be a convenient accessory for a user to hang a backpack, handbag, scarf and/or hat, underneath tabletop 402. An advantage of a magnetic coupling mechanism (as opposed to other coupling mechanisms, such as using screws to attach a hook to the bottom surface of tabletop 402) is the ease of assembly (i.e., no screw driver or hand-held drill is needed).

Control elements 116, 416*a* and 416*b* were previously described above in association with the light elements 410*a*, 410*b* and 410*c*, so no additional description will be provided in association with these control elements for conciseness.

Figure 4D:
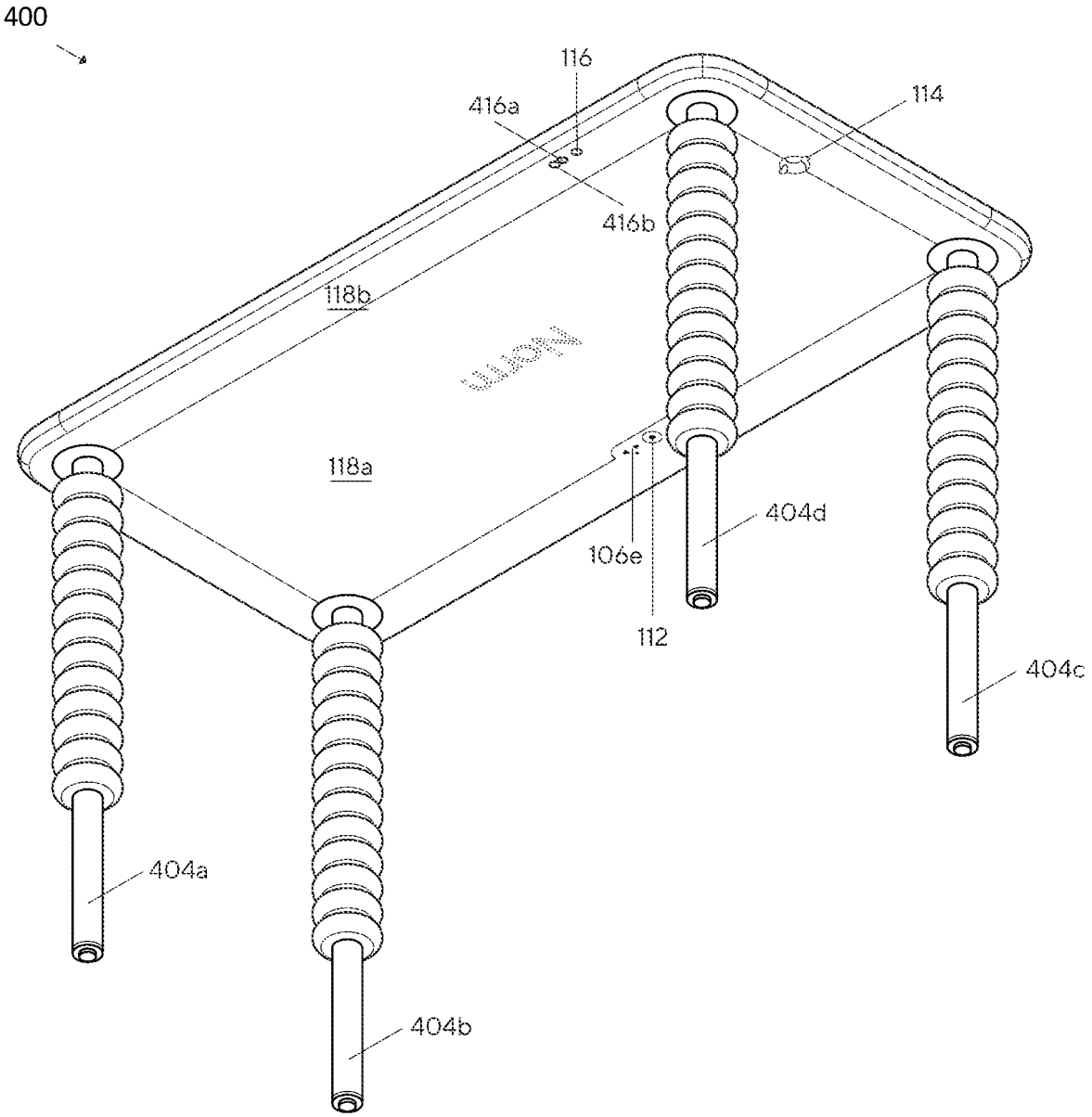
FIG. 4D depicts a bottom perspective view of the adjustable-height table, in accordance with one embodiment of the invention.

FIG. 4D depicts a bottom perspective view of adjustable-height table 400. The components that are visible in the bottom perspective view of adjustable-height table 400 are identical to the components that are visible in the bottom view of adjustable-height table 400, so no additional description will be provided in association with FIG. 4D for conciseness.

Figure 4E:
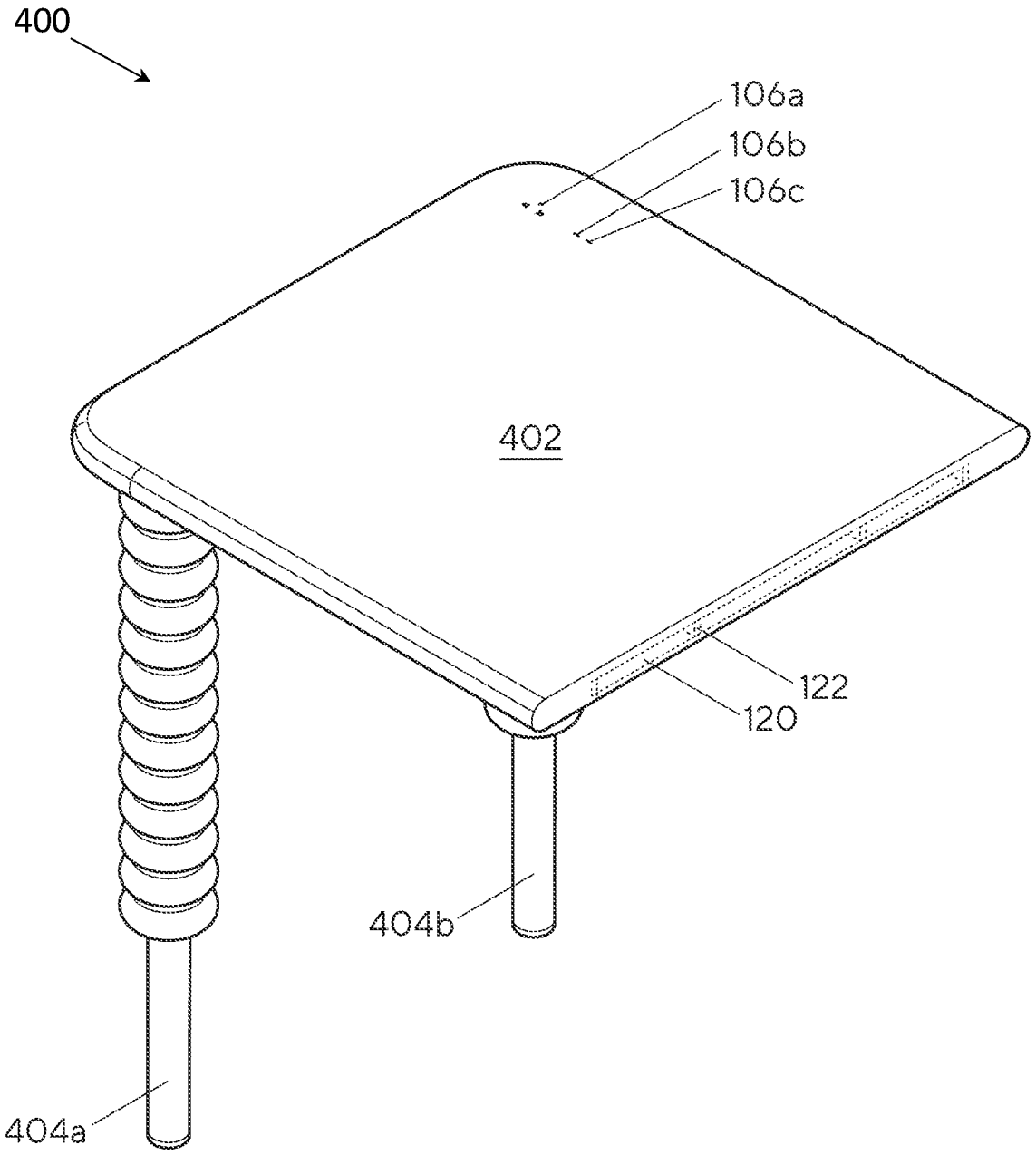
FIG. 4E depicts a sectional perspective view of the adjustable-height table with a cutting plane perpendicular to the top surface of the table, in accordance with one embodiment of the invention.

FIG. 4E depicts a sectional perspective view of adjustable-height table 400 with a cutting plane perpendicular to the plane of the top surface of the table. Cavity 120 is visible in the cross-sectional surface exposed in the sectional perspective view. Cavity 120 may include frame 122, which may be a grid made from a rigid material, such as aluminum.

Frame 122 may provide structural integrity to tabletop 402 (e.g., preventing warping, bending, sagging, etc.).

Figure 5A:
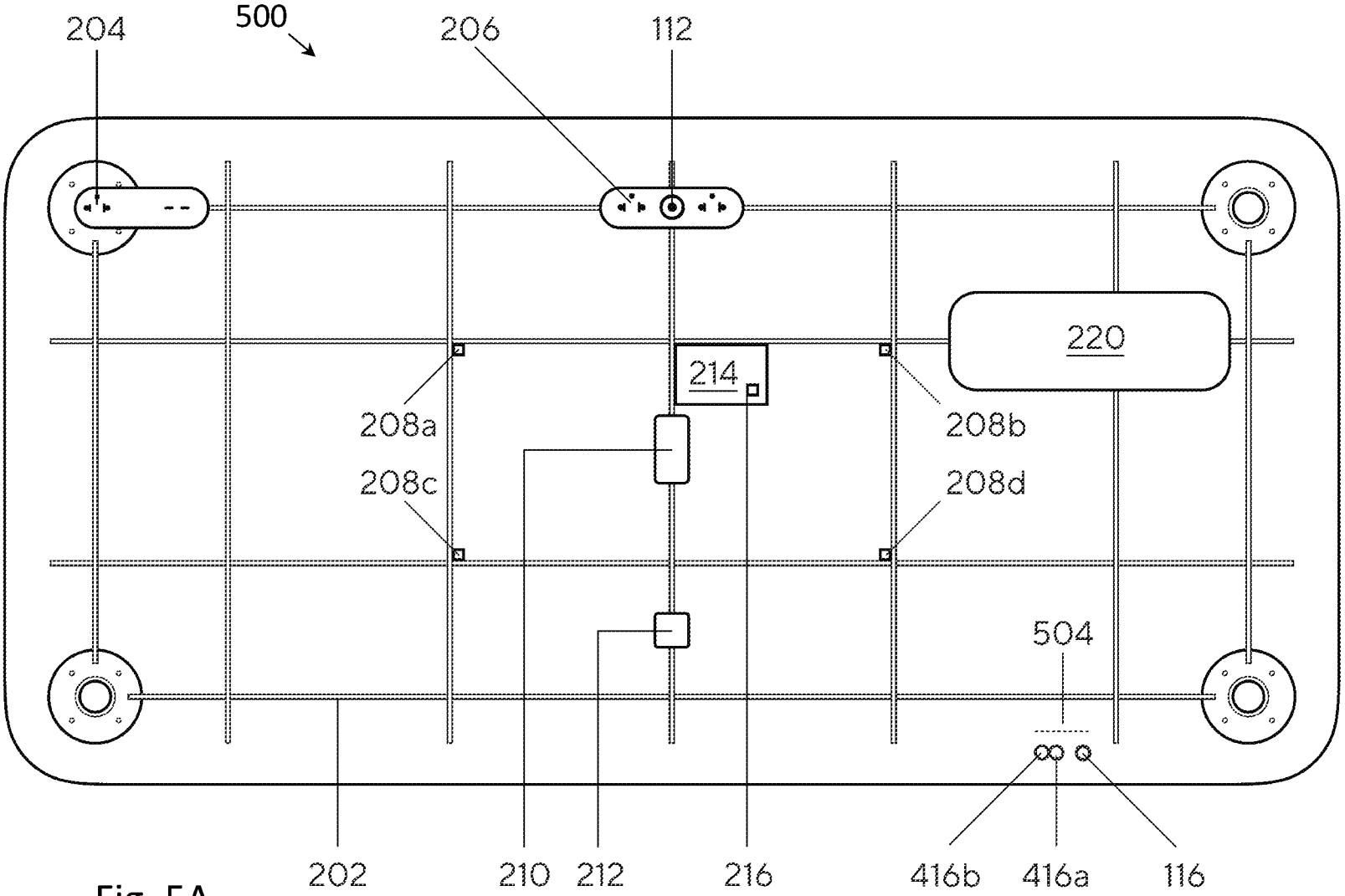
FIG. 5A depicts a top cross-sectional view of the adjustable-height table, in accordance with one embodiment of the invention.

FIG. 5A depicts a top cross-sectional view of tabletop 402 (i.e., cross-section of tabletop 102 when viewed from the top), in which various internal components of tabletop 402 are visible. Many of the internal components of tabletop 402 are identical to those of tabletop 102, and hence its description will not be repeated for conciseness. Additional components included in tabletop 402 include, among other components, wires to electrically connect power board 206 and computing device 214 to each of the adjustable legs, light sources 504, and control elements 416*a* and 416*b*.

Figure 5B:
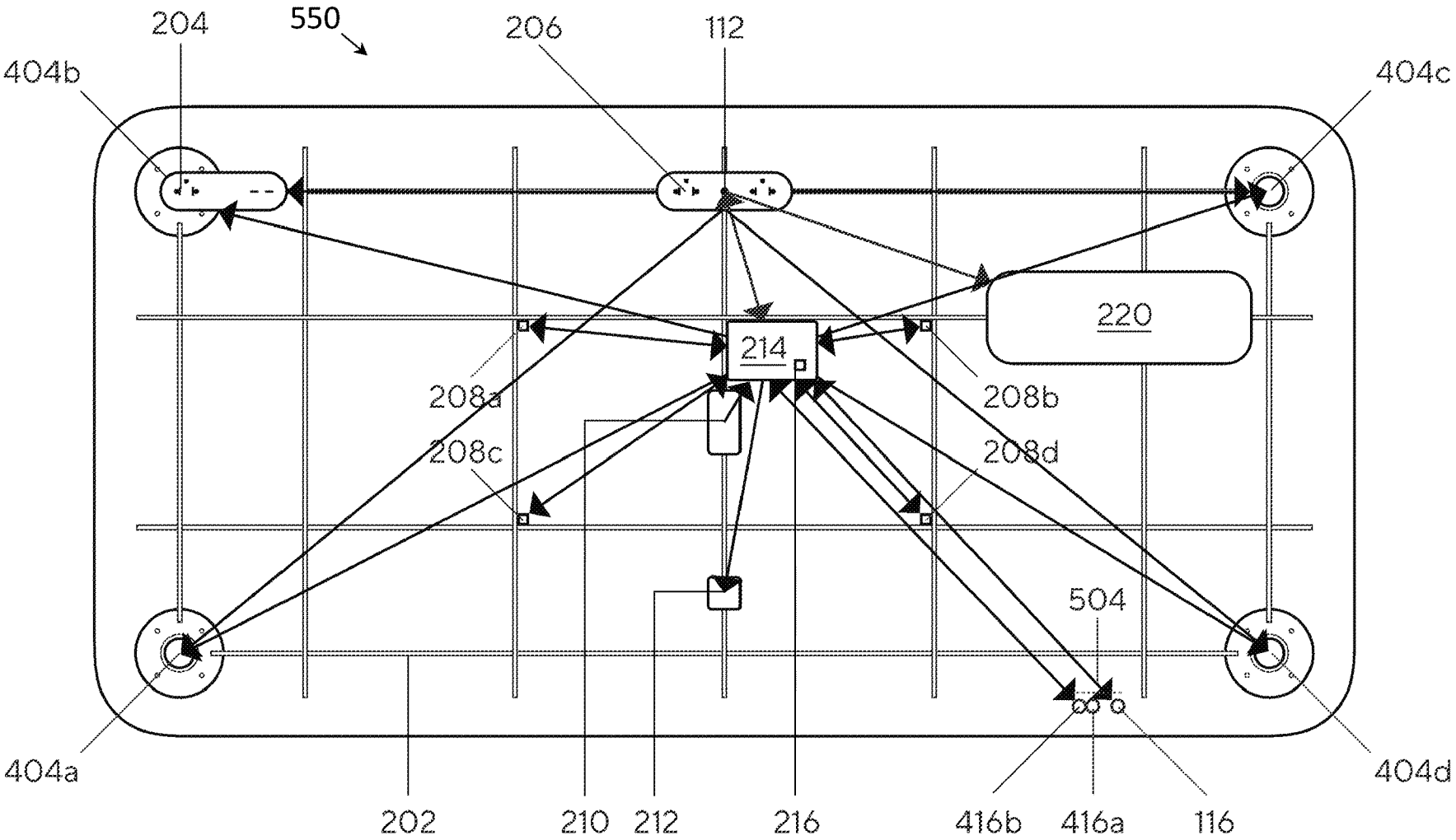
FIG. 5B depicts a schematic drawing in which various internal components of the adjustable-height table are electrically connected and/or communicatively coupled to one another, in accordance with one embodiment of the invention.

As shown in schematic diagram 550 of FIG. 5B, wires may electrically connect power board 206 to each of adjustable legs 404*a*, 404*b*, 404*c* and 404*d*. Computing device 214 may also be communicatively coupled to each of adjustable legs 404*a*, 404*b*, 404*c* and 404*d*, allowing computing device 214 to instruct the legs to extend and/or contract.

As shown in schematic diagram 550 of FIG. 5B, wires may electrically connect power board 206 to light sources 504. Computing device 214 may also be communicatively coupled to light sources 504, allowing computing device to turn on and off light sources 504, in response to detected tap gestures (or other gestures).

As shown in schematic diagram 550 of FIG. 5B, gyroscope 210 may be communicatively coupled to computing device 214, and can notify computing device 214 whether or not tabletop 402 is level and/or wobbling. In response to being notified that tabletop 204 is not level and/or not stable, computing device 214 may automatically transmit a control signal (e.g., height adjustment signal) to one or more of adjustable legs 404*a*, 404*b*, 404*c* and 404*d* in order to make the tabletop 204 more level or more stable.

As shown in schematic diagram 550 of FIG. 5B, control elements 416*a* and 416*b* (e.g., up/down controls) may be communicatively coupled to computing device 214. In response to receiving a signal from control element 416*a* (e.g., "down button"), computing device 214 may transmit a height adjustment signal to adjustable legs 404*a*, 404*b*, 404*c* and 404*d* requesting the legs to be shortened. Similarly, in response to receiving a signal from control element 416*b* (e.g., "up button"), computing device 214 may transmit a height adjustment signal to adjustable legs 404*a*, 404*b*, 404*c* and 404*d* requesting the legs to be extended.

Figure 6A:
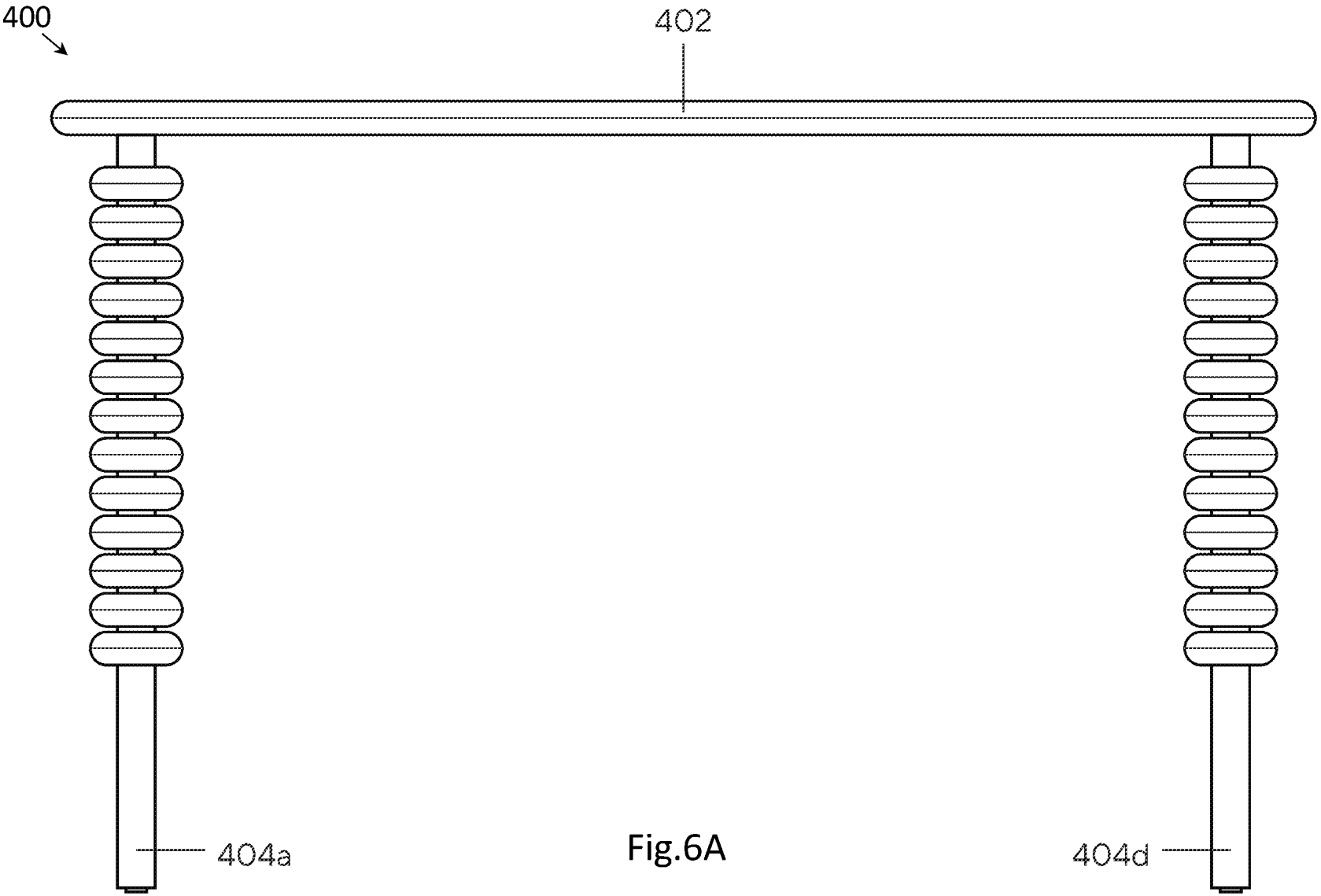
FIG. 6A depicts a front view of the adjustable-height table in a lowered position, in accordance with one embodiment of the invention.
Figure 6B:
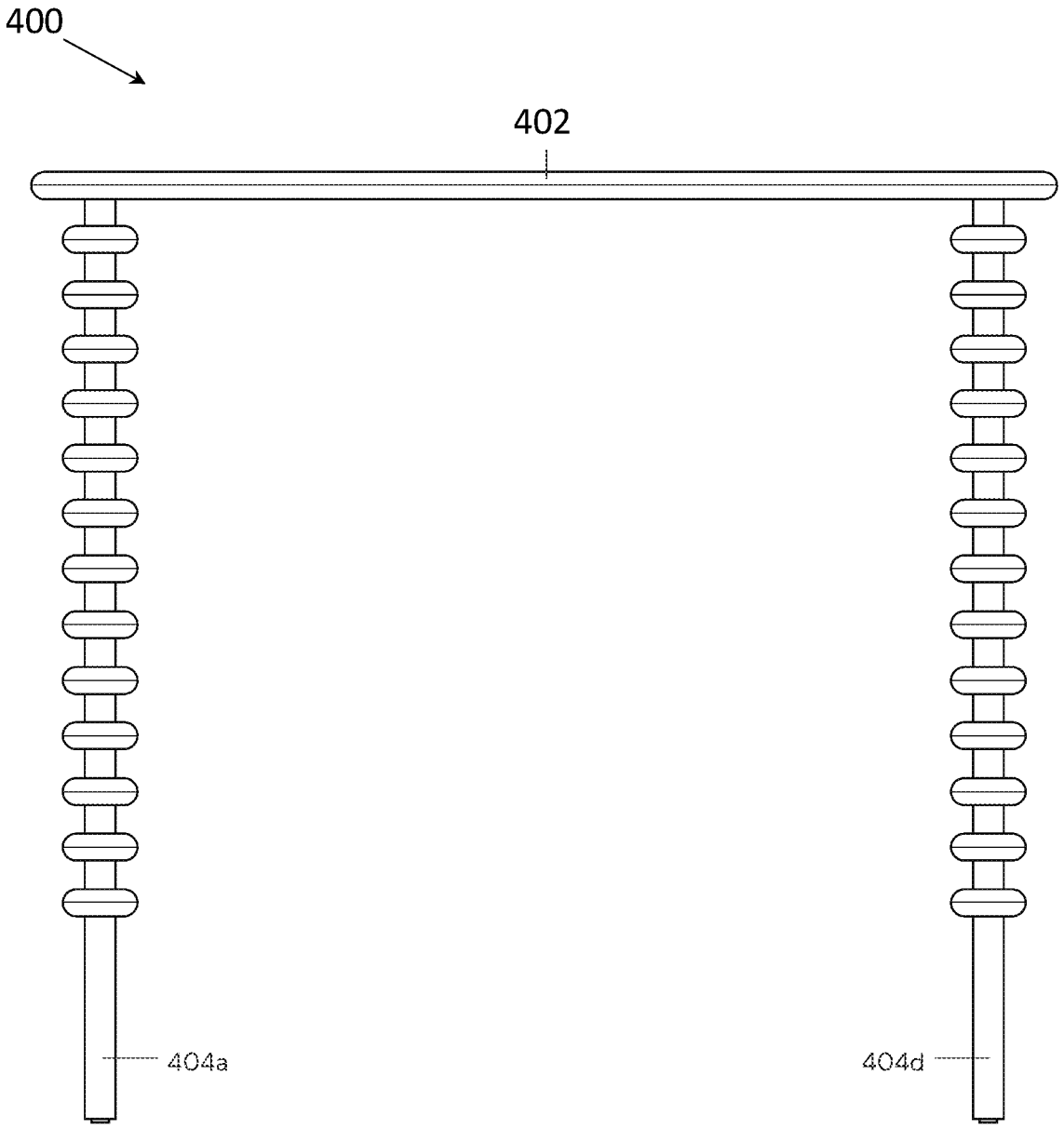
FIG. 6B depicts a front view of the adjustable-height table in a raised position, in accordance with one embodiment of the invention.

FIG. 6A depicts a front view of the adjustable-height table in a lowered position, and FIG. 6B depicts the front view of the adjustable-height table in a raised position.

Figure 7A:
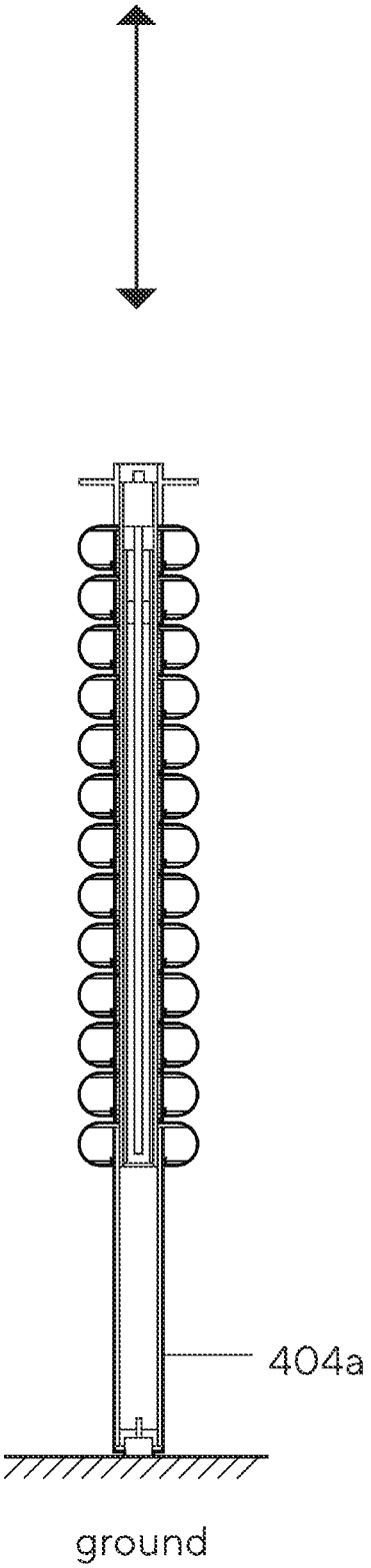
FIG. 7A depicts a cross-sectional view of an adjustable-height leg in a retracted position, in accordance with one embodiment of the invention.
Figure 7B:
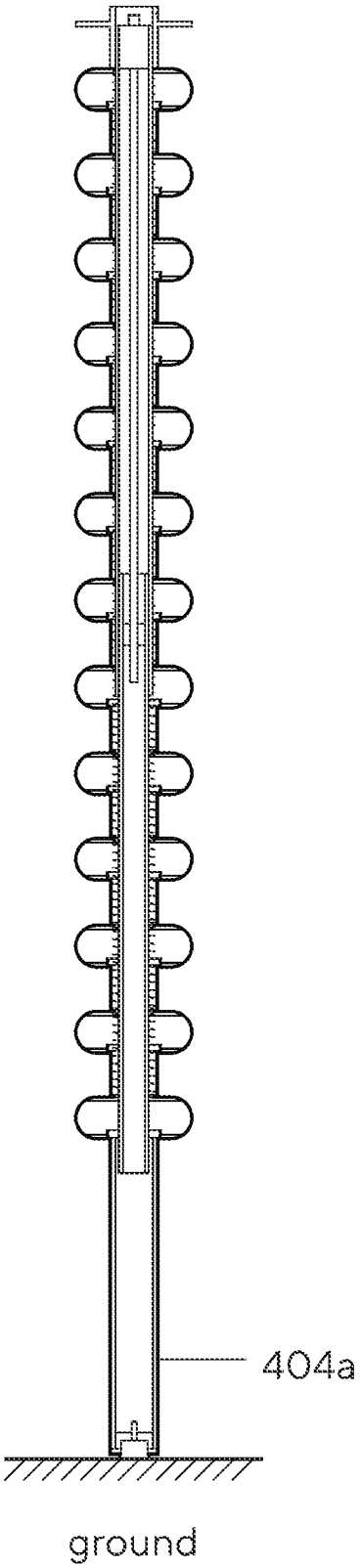
FIG. 7B depicts a cross-sectional view of an adjustable-height leg in an extended position, in accordance with one embodiment of the invention.

FIG. 7A depicts a cross-sectional view of adjustable-height leg 404*a* in a retracted position, FIG. 7B depicts the cross-sectional view of adjustable-height leg 404*a* in an extended position.

Figures 8A, 8B:
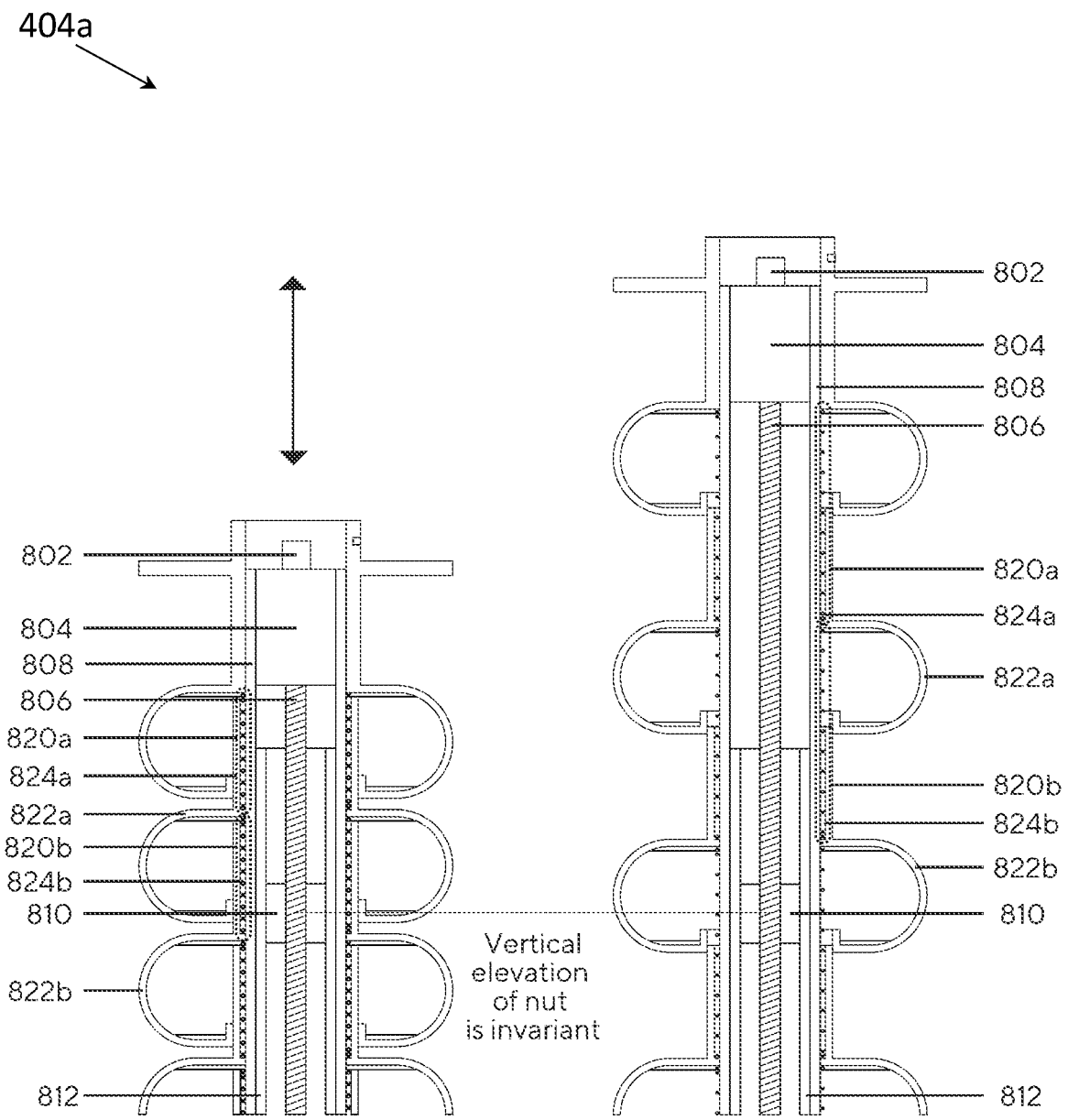
FIG. 8A depicts a cross-sectional view of a zoomed in portion of an adjustable-height leg in a retracted position, in accordance with one embodiment of the invention.
FIG. 8B depicts a cross-sectional view of a zoomed in portion of an adjustable-height leg in an extended position, in accordance with one embodiment of the invention.

FIG. 8A depicts a cross-sectional view of a zoomed in portion of adjustable-height leg 404*a* in a retracted position, and FIG. 8B depicts a cross-sectional view of a zoomed in portion of adjustable-height leg 404*a* in an extended position. The operation of adjustable-height leg 404*a* is described in association with FIGS. 8A and 8B. In one embodiment, adjustable-height leg 404*a* may comprise a linear actuator that is enclosed by a telescopic enclosure. In one embodiment, linear actuator may include motor 804, screw shaft 806, nut 810, inner tubular enclosure 812, and outer tubular enclosure 808. The operation of the linear actuator is now described.

Motor 804 is configured to receive power from power board 206 and one or more control signals from computing device 214 via port 802. In response to receiving a first control signal, motor 804 may rotate screw shaft 806 in a clockwise (or counterclockwise direction). In response to receiving a second control signal, motor 804 may rotate screw shaft 806 in a counterclockwise (or clockwise direction). Screw shaft 806 may be threaded through a central opening of nut 810, which is fixedly secured to inner tubular enclosure 814. Inner tubular enclosure 814 has a vertically invariant elevation with respect to the ground/floor on which adjustable-height table 400 rests (due to other supporting elements between inner tubular enclosure 814 and the ground/floor). Due to the fixed coupling between nut 810 and inner tubular enclosure 814, nut 810 importantly also has a vertically invariant elevation. Due to the vertically invariant elevation of nut 810, rotation of screw shaft causes motor 804 and outer tubular enclosure 808 (which is fixedly secured to motor 804) to either vertically translate upwards or downwards depending on the rotation direction of screw shaft 806.

In one embodiment, the telescopic enclosure comprises a plurality of bulbous members. In the preferred embodiment, telescopic enclosure includes thirteen bulbous members. For conciseness of explanation, two adjacent ones of the bulbous members will be described. A first bulbous member may comprise mushroom-stem portion 820*a* with a stem cavity, mushroom-cap portion 822*a* with a cap cavity, and coil spring 824*a* inserted (partially or fully) within the stem cavity of mushroom-stem portion 820*a*, depending on whether the leg is extended or contracted. A second bulbous member may comprise mushroom-stem portion 820*b* with a stem cavity, mushroom-cap portion 822*b* with a cap cavity, and coil spring 824*b* inserted (partially or fully) within the stem cavity of mushroom-stem portion 820*b* and the cap cavity of mushroom-cap portion 822*a*, depending on whether the leg is extended or contracted. In a compressed configuration of the telescopic enclosure, mushroom-stem portion 820*b* may be inserted into cap cavity of mushroom-cap portion 822*a*. In an elongated configuration of the telescopic enclosure, mushroom-stem portion 820*b* may be retracted from the cap cavity of mushroom-cap portion 822*a*.

Figure 9:
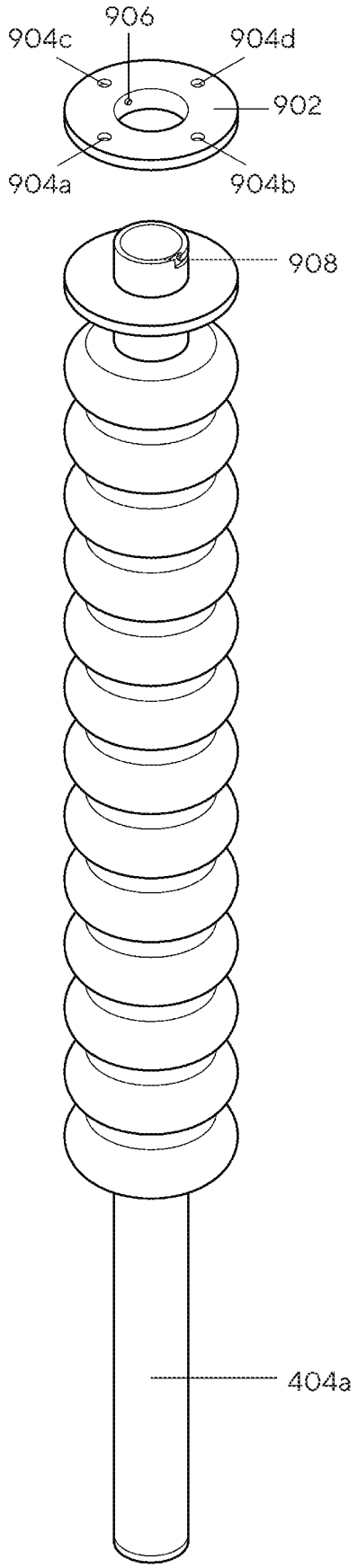
FIG. 9 depicts an exploded view of a leg and a leg anchoring component, in accordance with one embodiment of the invention.

FIG. 9 depicts an exploded view of height-adjustable leg 404*a* and leg anchoring component 902. Leg anchoring component 902 may be secured to a top or bottom surface of fixed panel 118*b* using screws. Four screw holes 904*a*, 904*b*, 904*c* and 904*d* are illustrated in leg anchoring component 902, so in the embodiment of FIG. 9, four screws (not depicted) are used to secure leg anchoring component 902 to the top or bottom surface of fixed panel 118*b*.

Leg anchoring component 902 may include one or more radial pins 906 (e.g., radially protruding into the cavity of leg anchoring component 902) which are configured to be received in one or more L-shaped slots 908 of adjustable leg, in a bayonet mount fastening mechanism. In another embodiment (not depicted), the radial pins may instead be disposed on adjustable-height leg 404 (e.g., radially protruding outwards from the central axis of adjustable-height leg 404) and the L-shaped slots may be located on an inner side surface of leg anchoring component 902.

Figure 10:
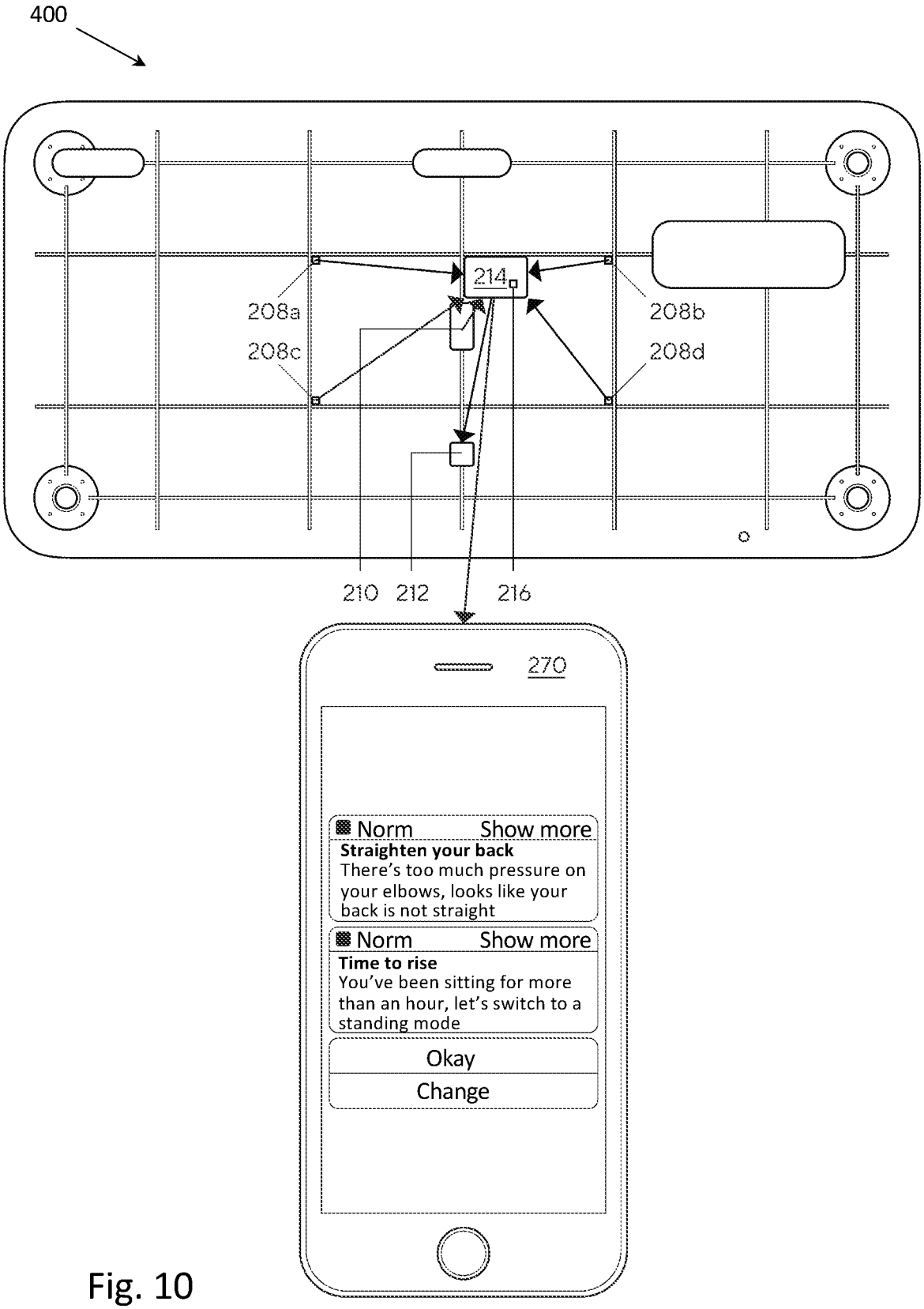
FIG. 10 depicts a system diagram of the table communicatively coupled with a mobile device, in accordance with one embodiment of the invention.

FIG. 10 depicts a system diagram of adjustable-height table 400, in which computing device 214 is communicatively coupled to mobile device 270 (or a user's laptop, desktop, etc.). It is understood that fixed-height table 100 may also be communicatively coupled to mobile device 270 in a similar fashion, but certain details described in FIG. 10 may not apply to a fixed-height table (e.g., instruction to switch to a standing mode).

Computing device 214 may receive pressure readings from pressure sensors 208*a*, 208*b*, 208*c* and 208*d* and/or a signal from gyroscope 210. Based on such detected sensor signals, computing device 214 may determine, using machine learning, a posture of the user. The use of machine learning is described in more detail in FIG. 11. In the illustrated example, the determined posture is then determined to deviate from a proper ergonomic position. As a result, a message to straighten the user's back is transmitted from computing device 214 to mobile 270 and displayed thereon. Also in the illustrated example, based on the detected sensor signals, computing device 214 determines that the user has been sitting for more than one hour (e.g., there has been intermittent pressure on one or more of the pressure sensors for the last hour and the table is in a lowered position, implying a seating position). As a result, a message to switch to a standing mode is suggested to the user (i.e., suggestion to raise the height of the table).

Figure 11:
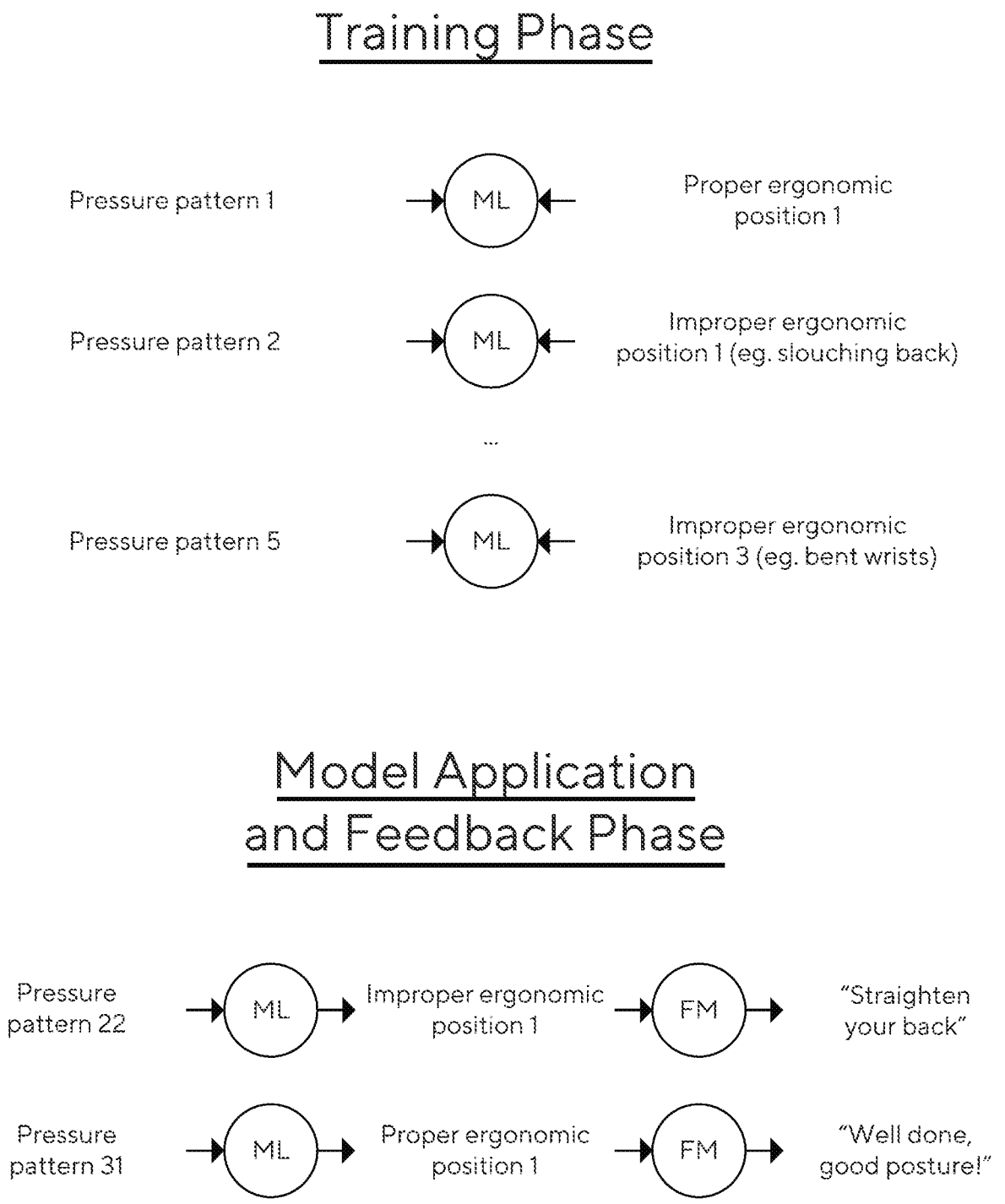
FIG. 11 depicts an example of how a posture of the user (whether ergonomic or not ergonomic) can be determined from a pressure pattern, in accordance with one embodiment of the invention.

FIG. 11 depicts an example of how a posture of the user (whether ergonomic or not ergonomic) can be determined from a pressure pattern. In a training phase, known input/output pairs may be provided to a machine learning (abbreviated as "ML" in FIG. 11) module of computing device 214. The input may include a pressure pattern, and the output may include whether the user's posture conforms or does not conform with a proper ergonomic position, and in the case where it does not conform, the output may include the specific issue with the posture (e.g., slouching back, bent wrists, etc.). In the illustrated example, pressure pattern 1 (input) is paired with an identification of a proper ergonomic position 1 (output); pressure pattern 2 (input) is paired with an identification of improper ergonomic position 1 (i.e., slouching back) (output); . . . and pressure pattern 5 (input) is paired with an identification of improper ergonomic position 3 (i.e., bent wrists) (output). Based on such known input/output pairs, parameters of the machine learning module are optimized (e.g., via a backpropagation algorithm).

After the machine learning module has been trained in the training phase, the machine learning module may be used to evaluate the posture of the user based on detected pressure patterns (i.e., in a model application phase). In the example of FIG. 11, a feedback module (abbreviated as FM) is also present, which takes the inferred posture from the machine learning module and determines an appropriate remediation measure (or if no remediation is needed, then compliments to the user on his or her proper posture). In the illustrated example, the machine learning module infers improper ergonomic position 1 (slouching back) based on pressure pattern 22 (which has some similarities to pressure pattern 2), and the feedback module determines the remediation measure of "Straighten your back" as a proper remediation measure for improper ergonomic position 1. Also in the illustrated example, the machine learning module infers proper ergonomic position 1 based on pressure pattern 31 (which has some similarities to pressure pattern 1), and the feedback module determines that words of encouragement (e.g., "Well done, good posture!") to the user are proper based on the user's proper ergonomic position.

Figure 12:
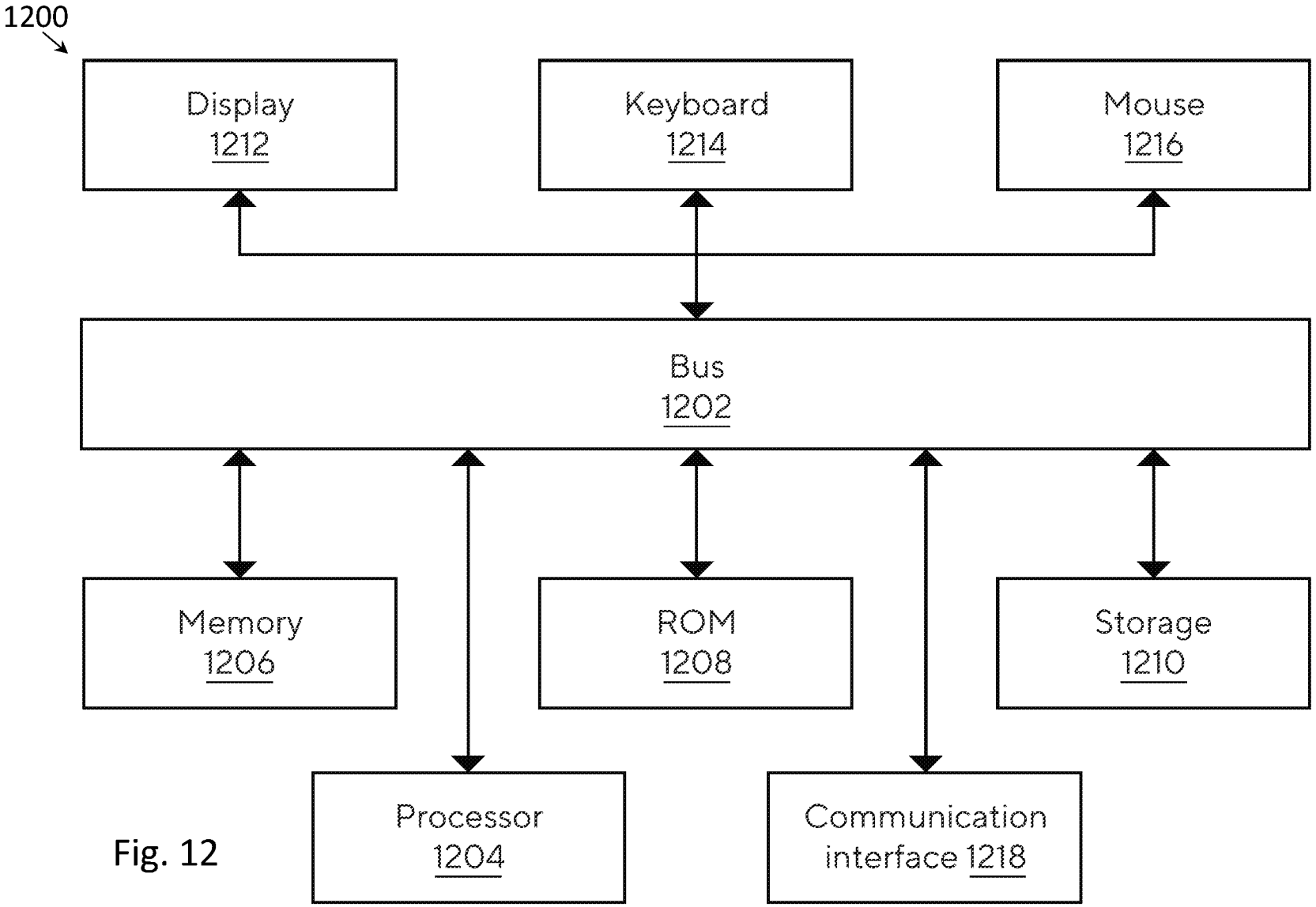
FIG. 12 depicts components of a computer system in which computer readable instructions instantiating the methods of the present invention may be stored and executed.

As is apparent from the foregoing discussion, aspects of the present invention involve the use of various computer systems and computer readable storage media having computer-readable instructions stored thereon. FIG. 12 provides an example of a system 1200 that may be representative of any of the computing systems (e.g., computing device 214) discussed herein. Examples of system 1200 may include a smartphone, a desktop, a laptop, a mainframe computer, an embedded system, etc. Note, not all of the various computer systems have all of the features of system 900. For example, certain ones of the computer systems discussed above may not include a display inasmuch as the display function may be provided by a client computer communicatively coupled to the computer system or a display function may be unnecessary. Such details are not critical to the present invention.

System 1200 includes a bus 1202 or other communication mechanism for communicating information, and a processor 1204 coupled with the bus 1202 for processing information. Computer system 1200 also includes a main memory 1206, such as a random access memory (RAM) or other dynamic storage device, coupled to the bus 1202 for storing information and instructions to be executed by processor 1204. Main memory 1206 also may be used for storing temporary variables or other intermediate information during execution of instructions to be executed by processor 1204. Computer system 1200 further includes a read only memory (ROM) 1208 or other static storage device coupled to the bus 1202 for storing static information and instructions for the processor 1204. A storage device 1210, for example a hard disk, flash memory-based storage medium, or other storage medium from which processor 1204 can read, is provided and coupled to the bus 1202 for storing information and instructions (e.g., operating systems, applications programs and the like).

Computer system 1200 may be coupled via the bus 1202 to a display 1212, such as a flat panel display, for displaying information to a computer user. An input device 1214, such as a keyboard including alphanumeric and other keys, may be coupled to the bus 1202 for communicating information and command selections to the processor 1204. Another type of user input device is cursor control device 1216, such as a mouse, a trackpad, or similar input device for communicating direction information and command selections to processor 1204 and for controlling cursor movement on the display 1212. Other user interface devices, such as microphones, speakers, etc. are not shown in detail but may be involved with the receipt of user input and/or presentation of output.

The processes referred to herein may be implemented by processor 1204 executing appropriate sequences of computer-readable instructions contained in main memory 1206. Such instructions may be read into main memory 1206 from another computer-readable medium, such as storage device 1210, and execution of the sequences of instructions contained in the main memory 1206 causes the processor 1204 to perform the associated actions. In alternative embodiments, hard-wired circuitry or firmware-controlled processing units may be used in place of or in combination with processor 1204 and its associated computer software instructions to implement the invention. The computer-readable instructions may be rendered in any computer language.

In general, all of the above process descriptions are meant to encompass any series of logical steps performed in a sequence to accomplish a given purpose, which is the hallmark of any computer-executable application. Unless specifically stated otherwise, it should be appreciated that throughout the description of the present invention, use of terms such as "processing", "computing", "calculating", "determining", "displaying", "receiving", "transmitting" or the like, refer to the action and processes of an appropriately programmed computer system, such as computer system 1200 or similar electronic computing device, that manipulates and transforms data represented as physical (electronic) quantities within its registers and memories into other data similarly represented as physical quantities within its memories or registers or other such information storage, transmission or display devices.

Computer system 1200 also includes a communication interface 1218 coupled to the bus 1202. Communication interface 1218 may provide a two-way data communication channel with a computer network, which provides connectivity to and among the various computer systems discussed above. For example, communication interface 1218 may be a local area network (LAN) card to provide a data communication connection to a compatible LAN, which itself is communicatively coupled to the Internet through one or more Internet service provider networks. The precise details of such communication paths are not critical to the present invention. What is important is that computer system 1200 can send and receive messages and data through the communication interface 1218 and in that way communicate with hosts accessible via the Internet. It is noted that the components of system 1200 may be located in a single device or located in a plurality of physically and/or geographically distributed devices.

Thus, a table with one or more tap gesture-activated light indicators has been described. It is to be understood that the above-description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A table, comprising:

a tabletop;

a plurality of legs attached to the tabletop so as to support the tabletop;

one or more sensors disposed within or proximate to the tabletop for detecting a tap gesture performed by a user on a surface of the tabletop;

one or more light sources configured to shine light through a translucent portion of the surface of the tabletop so as to generate one or more light indicators on the surface of the tabletop;

a processor;

a memory storing instructions that, when executed by the processor, cause the processor to switch on the one or more light sources in response to receiving a signal from the one or more sensors indicating the detection of the tap gesture, one or more wireless charging areas located on a top portion of the surface of the tabletop; and one or more wireless chargers disposed immediately beneath a corresponding one of the one or more wireless charging areas, the one or more wireless chargers configured to wirelessly charge a battery of a mobile device, wherein at least one of the one or more light indicators indicates respective locations of the one or more wireless charging areas.

2. The table of claim 1, wherein the one or more sensors include one or more of a vibration sensor or a gyroscope configured to detect vibrations generated by the tap gesture.

3. The table of claim 1, wherein the one or more sensors include at least one pressure sensor disposed on the surface of the tabletop or disposed within the tabletop, the at least one pressure sensor configured to detect a wave traveling through or along the tabletop as a result of the tap gesture performed by the user.

4. The table of claim 1, wherein at least one of the one or more light indicators indicates a position of a control element disposed on the surface of the tabletop, and wherein the control element, when pressed by the user, is configured to cause a height of the table to be raised.

5. The table of claim 1, wherein at least one of the one or more light indicators indicates a position of a control element disposed on the surface of the tabletop, and wherein the control element, when pressed by the user, is configured to cause a height of the table to be lowered.

6. The table of claim 1, wherein at least one of the one or more light indicators indicates a position of a button on a bottom portion of the surface of the tabletop that, when pressed by the user, causes the detection of the tap gesture to be enabled or disabled.

7. The table of claim 1, further comprising one or more universal serial bus (USB) outlets disposed on the surface of the tabletop.

8. The table of claim 7, wherein the one or more USB outlets is a USB-C outlet.

9. The table of claim 1, further comprising one or more power outlets disposed on the surface of the tabletop.

10. The table of claim 9, wherein the one or more power outlets are disposed adjacent to or above one or more of the legs of the table, allowing liquid that is spilled into the one or more power outlets to drain from the one or more power outlets through one or more of the legs of the table.

11. The table of claim 1, further comprising a gyroscope configured to determine whether or not the tabletop is level.

12. The table of claim 1, further comprising a coupling mechanism disposed on a bottom portion of the surface of the tabletop that is configured to releasably couple with a hook.

13. The table of claim 12, wherein the coupling mechanism is a magnetic coupling.

14. The table of claim 1, wherein each of the legs is coupled to the tabletop via a bayonet mount.

15. The table of claim 1, wherein the tabletop comprises:

an acrylic stone exterior; and an internal cavity within the acrylic stone exterior, the internal cavity comprising a grid frame.

16. The table of claim 15, wherein a bottom portion of the surface of the tabletop includes a removable panel, wherein removal of the removable panel from the tabletop exposes the grid frame of the internal cavity.

17. The table of claim 1, wherein each of the plurality of legs is a height-adjustable leg, wherein each of the height-adjustable legs comprises:

a linear actuator; and a telescopic enclosure.

18. The table of claim 17, wherein the linear actuator comprises:

a nut, wherein a vertical elevation of the nut is invariant;

a screw shaft screwed through a central opening of the nut;

a motor configured to rotate the screw shaft about a rotational axis of the screw shaft;

an inner tubular enclosure fixedly secured to the nut; and an outer tubular enclosure fixedly secured to the motor, wherein rotation of the screw shaft causes the outer tubular enclosure to vertically translate with respect to the inner tubular enclosure.

19. The table of claim 18, wherein the telescopic enclosure encloses the outer tubular enclosure, wherein the telescopic enclosure comprises a plurality of bulbous members.

20. The table of claim 19, wherein the plurality of bulbous members comprises a first bulbous member that is adjacent to a second bulbous member, wherein the first bulbous member comprises:

a first mushroom-stem portion with a first stem cavity;

a first mushroom-cap portion with a first cap cavity; and a first coil spring inserted within the first stem cavity, wherein the second bulbous member comprises:

a second mushroom-stem portion with a second stem cavity;

a second mushroom-cap portion with a second cap cavity; and a second coil spring inserted within the second stem cavity and the first cap cavity, wherein in a compressed configuration of the telescopic enclosure, the second mushroom-stem portion is inserted into the first cap cavity, and wherein in an elongated configuration of the telescopic enclosure, the second mushroom-stem portion is retracted from the first cap cavity.

* * * * *